US008593378B2

(12) United States Patent
Ryu et al.

(10) Patent No.: US 8,593,378 B2
(45) Date of Patent: Nov. 26, 2013

(54) ORGANIC LIGHT EMITTING DISPLAY

(75) Inventors: Do Hyung Ryu, Suwon (KR); Bo Yong Chung, Seoul (KR); Oh Kyong Kwon, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 1595 days.

(21) Appl. No.: 11/490,943

(22) Filed: Jul. 20, 2006

(65) Prior Publication Data

US 2007/0024541 A1 Feb. 1, 2007

(30) Foreign Application Priority Data

Aug. 1, 2005 (KR) ..... 10-2005-0070434

(51) Int. Cl.
*G09G 3/30* (2006.01)
*G09G 3/10* (2006.01)
*G11C 19/00* (2006.01)

(52) U.S. Cl.
USPC ..... 345/77; 345/76; 345/78; 315/169.3; 377/72

(58) Field of Classification Search
USPC ..... 345/76–83; 315/169.3; 377/64, 70–73
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,859,193 | B1 | 2/2005 | Yumoto | |
| 7,071,905 | B1 * | 7/2006 | Fan | 345/76 |
| 2002/0101172 | A1 * | 8/2002 | Bu | 315/169.3 |
| 2002/0118150 | A1 * | 8/2002 | Kwon | 345/76 |
| 2004/0066357 | A1 * | 4/2004 | Kawasaki | 345/76 |
| 2004/0095297 | A1 * | 5/2004 | Libsch et al. | 345/76 |
| 2004/0100430 | A1 * | 5/2004 | Fruehauf | 345/82 |
| 2004/0104870 | A1 | 6/2004 | Mametsuka | |
| 2004/0252089 | A1 * | 12/2004 | Ono et al. | 345/82 |

FOREIGN PATENT DOCUMENTS

| | | |
|---|---|---|
| EP | 1 465 141 A1 | 10/2004 |
| EP | 1 465 143 B1 | 9/2006 |
| EP | 1 796 070 A1 | 6/2007 |

(Continued)

OTHER PUBLICATIONS

In Hai-Jun et al., A Novel Voltage-Programming Pixel with Current-Correction Method for Large-Size and High-Resolution AMOLEDs aon Poly-Si Backplane, IMID Digest Jul. 23, 2005, pp. 901-904, XP-002405123.*

(Continued)

*Primary Examiner* — Jonathan Horner
(74) *Attorney, Agent, or Firm* — Christie, Parker & Hale, LLP

(57) ABSTRACT

An organic light emitting display device capable of displaying an image of uniform brightness. A scan driver drives scan lines and light emitting control lines that are formed parallel to each other. A data driver drives data lines formed at a direction intersecting the scan lines and the light emitting control lines, and pixels are disposed to be coupled with the scan lines, the light emitting control lines, and the data lines. An auxiliary line is formed parallel to the data lines. One side of the auxiliary line is coupled with a reference power supply and another side of the auxiliary line is coupled with a current source. Connectors are disposed at crossing areas of the auxiliary line and the scan lines. A voltage transfer unit is coupled with the connectors and transfers a voltage supplied to the connectors to the data driver.

22 Claims, 14 Drawing Sheets

(56) References Cited

FOREIGN PATENT DOCUMENTS

| | | |
|---|---|---|
| KR | 10-2004-0009573 | 1/2004 |
| KR | 10-2004-0061902 | 7/2004 |
| WO | WO 2005/029456 A1 | 3/2005 |
| WO | WO 2005/069267 A1 | 7/2005 |

OTHER PUBLICATIONS

Choi, Sang-Moo et al., P-11: An Improved Voltage Programmed Pixel Structure for Large Size and High Resolution AM-OLED Displays, in SID'04 Tech. Dig., 2004, pp. 260-263.*

Patent Gazette dated Jan. 21, 2009 for corresponding Chinese Patent No. CN 100454372C.

Chinese Patent Office Action, Application No. CN 200610007776.1, dated Feb. 5, 2008, with English translation.

Korean Patent Abstracts, Publication No. 1020040009573 A, dated Jan. 31, 2004, in the name of Jeong Hui Choi.

Korean Patent Abstracts, Publication No. 1020040061902 A, dated Jul. 7, 2004, in the name of Han Sang Lee et al.

In, H et al., *A Novel Voltage-Programming Pixel with Current-Correction Method for Large Size and High-Resolution AMOLEDs on Ply-Si Backplane*, IMID Digest Jul. 23, 2005, pp. 901-904, XP-002405123.

Matsueda, Y, et al., *35.1: 2.5-in. AMOLED with Integrated 6-Bit Gamma Compensated Digital Data Driver*, 2004 SID International Symposium, Seattle, WA, May 25-27, 2004, pp. 1116-1119, XP007011917.

European Search Report dated Jul. 24, 2007, for EP06251612.5, in the name of Samsung SDI Co., Ltd.

European Search Report dated Feb. 10, 2011, for corresponding European Patent application 06251612.5.

* cited by examiner

ORGANIC LIGHT EMITTING DISPLAY

CROSS-REFERENCE TO RELATED APPLICATION

This application claims priority to and the benefit of Korean Patent Application No. 10-2005-0070434, filed on Aug. 1, 2005, in the Korean Intellectual Property Office, the entire content of which is incorporated herein by reference.

BACKGROUND

1. Field of the Invention

The present invention relates to an organic light emitting display, and more particularly to an organic light emitting display that can display an image of uniform brightness.

2. Discussion of Related Art

Recently, various flat panel display devices have been developed to substitute for a cathode ray tube (CRT) display because the CRT display is relatively heavy and bulky. Flat panel display devices include liquid crystal displays (LCDs), field emission displays (FEDs), plasma display panels (PDPs), organic light emitting display devices, etc.

An organic light emitting display device is a flat display device that displays an image using an organic light emitting diode that generates light by the recombination of electrons and holes. Such an organic light emitting display device has advantages in that it has a high response speed, and operates with a low power consumption.

FIG. 1 is a view showing a conventional organic light emitting display device. With reference to FIG. 1, the conventional organic light emitting display device includes a display region 30, a scan driver 10, a data driver 20, and a timing controller 50. The display region 30 includes a plurality of pixels 40 coupled with scan lines S1 to Sn and data lines D1 to Dm. The scan driver 10 drives the scan lines S1 to Sn. The data driver 20 drives the data lines D1 to Dm. The timing controller 50 controls the scan driver 10 and the data driver 20.

The timing controller 50 generates a data drive control signal DCS and a scan drive control signal SCS according to externally supplied synchronous signals. The data drive control signal DCS generated by the timing controller 50 is provided to the data driver 20, and the scan drive control signal SCS is provided to the scan driver 10. Furthermore, the timing controller 50 provides externally supplied data Data to the data driver 20.

The scan driver 10 receives the scan drive control signal SCS from the timing controller 50. Upon the receipt of the scan drive control signal SCS, the scan driver generates a scan signal, and sequentially provides the generated scan signal to the scan lines S1 to Sn.

The data driver 20 receives the data drive control signal DCS from the timing controller 50. Upon the receipt of the data drive control signal DCS, the data driver 20 generates a data signal (predetermined voltage), and provides the generated data signal to the data lines D1 to Dm in synchronization with the scan signal.

The display region 30 receives a first power of a first power supply ELVDD and a second power of a second power supply ELVSS from an exterior, and provides them to respective pixels 40. Upon the receipt of the first power of the first power supply ELVDD and the second power of the second power supply ELVSS, each of the pixels 40 controls an amount of current flowing into the second power supply ELVSS from the first power supply ELVDD through an organic light emitting diode corresponding to the data signal, thus generating light corresponding to the data signal.

That is, in the conventional organic light emitting display device, each of the pixels 40 generates light of a predetermined luminance corresponding to the data signal. However, due to non-uniformity of threshold voltages and a deviation of electron mobility of transistors included in each pixel 40, the conventional organic light emitting display device has a problem in that it cannot display an image of a desired (or uniform) luminance. In practice, threshold voltages of transistors included in each of the pixels 40 can be compensated to some degree by controlling a construction of pixel circuits included in the pixels 40, but a deviation of electron mobility cannot be compensated. In order to solve the problem, an electric current (instead of a voltage) can be supplied as a data signal. In practice, when the electric current is supplied as the data signal, although the transistors have non-uniform voltage-current characteristics, the organic light emitting display device can display a uniform image at the display region 30.

However, because the current supplied as the data signal is a minute current, it takes a long time to charge a data line. For example, assuming that a load capacitance of the data line is 30 pF, a time of several ms is required to charge a load of the data line by a data signal ranging from several tens nA to several hundreds nA. Upon considering one (1) horizontal period of several tens μs, a charge time of several ms may be too long. Therefore, an organic light emitting display device capable of displaying uniform brightness with a fast response time is still required.

SUMMARY OF THE INVENTION

Accordingly, it is an aspect of the present invention to provide an organic light emitting display device capable of displaying an image of uniform brightness with a fast response time.

An embodiment of the present invention provides an organic light emitting display device including: a scan driver for driving a scan line and a light emitting control line, the scan line and the light emitting control line being formed parallel to each other; a data driver for driving a data line formed at a direction intersecting the scan line and the light emitting control line; a pixel disposed to be coupled with the scan line, the light emitting control line, and the data line; an auxiliary line formed parallel to the data line, one side of the auxiliary line being coupled with a reference power supply and another side of the auxiliary line being coupled with a current source; a connector disposed at a crossing area of the auxiliary line and the scan line; and a voltage transfer unit coupled with the connector for transferring a voltage supplied to the connector to the data driver.

In one embodiment, the scan driver provides a scan signal and a light emitting control signal to the scan line and the light emitting control line, respectively; the data driver is coupled with the data lines during a first period of one horizontal period for receiving a predetermined current from the pixel selected according to the scan signal, and for resetting a voltage value of a data signal using a compensation voltage generated when the predetermined current is received, and for providing the reset voltage value of the data signal to the pixel during a second period of the one horizontal period, the second period being a period other than the first period. In one embodiment, the current source receives substantially the same current as the predetermined current from the reference power supply via the auxiliary line. In one embodiment, a current value of the predetermined current is set to be substantially identical with a current value of an electric current flowing through an organic light emitting diode when the pixel emits light of a maximum brightness.

According to another embodiment of the present invention, there is provided an organic light emitting display device, including: an organic light emitting display device, comprising: a display region including a pixel coupled with a scan line, a light emitting control line, and a data line; a scan driver for providing a scan signal and a light emitting control signal to the scan line and the light emitting control line, respectively; a data driver coupled with the data line during a first period of one horizontal period for receiving a predetermined current from the pixel selected according to the scan signal, the data driver being for resetting a voltage value of a data signal using a compensation voltage generated when the predetermined current is received and for providing the reset voltage value of the data signal to the pixel during a second period of the one horizontal period, the second period being a period other than the first period; a voltage generator for generating and providing a voltage increased by a predetermined level in every horizontal period when the scan signal is supplied to the data driver.

In one embodiment, the voltage generator provides the voltage increased by the predetermined voltage every time an external horizontal sync signal is supplied to the data driver, and is initialized when an external vertical sync signal is supplied. In one embodiment, a voltage generated by the voltage generator is set to be substantially identical with a voltage drop of the compensation voltage generated by the data lines. In one embodiment, the data driver boosts a voltage value of the compensation voltage by a voltage value generated by the voltage generator.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
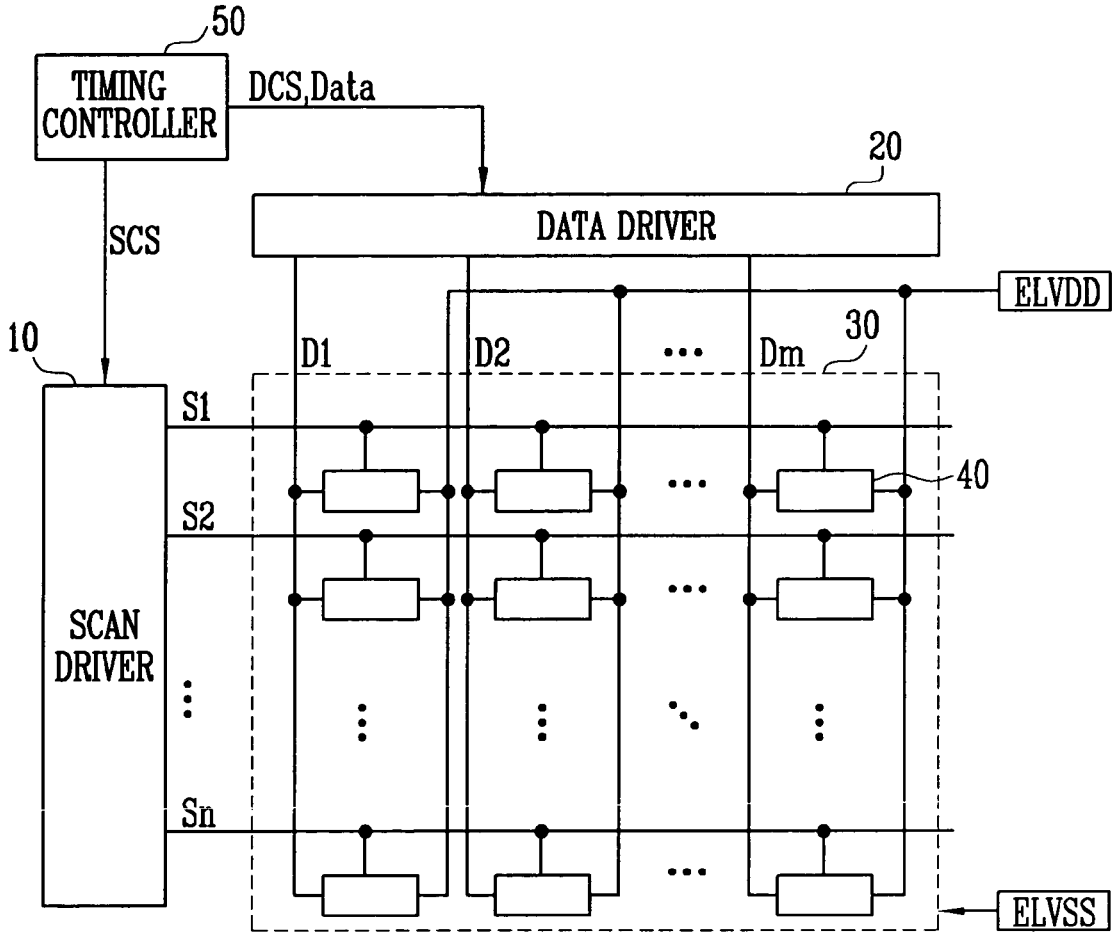
FIG. 1 (PRIOR ART)
FIG. 1 is a view showing a conventional organic light emitting display device.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive. There may be parts shown in the drawings, or parts not shown in the drawings, that are not discussed in the specification as they are not essential to a complete understanding of the invention. Like reference numerals designate like elements. Here, when a first element is connected to/with a second element, the first element may not only be directly connected to/with the second element but also be indirectly connected to/with the second element via a third element. Also, when a first element is on a second element, the first element may not only be directly on the second element but may also be indirectly on the second element via a third element.

Figure 2:
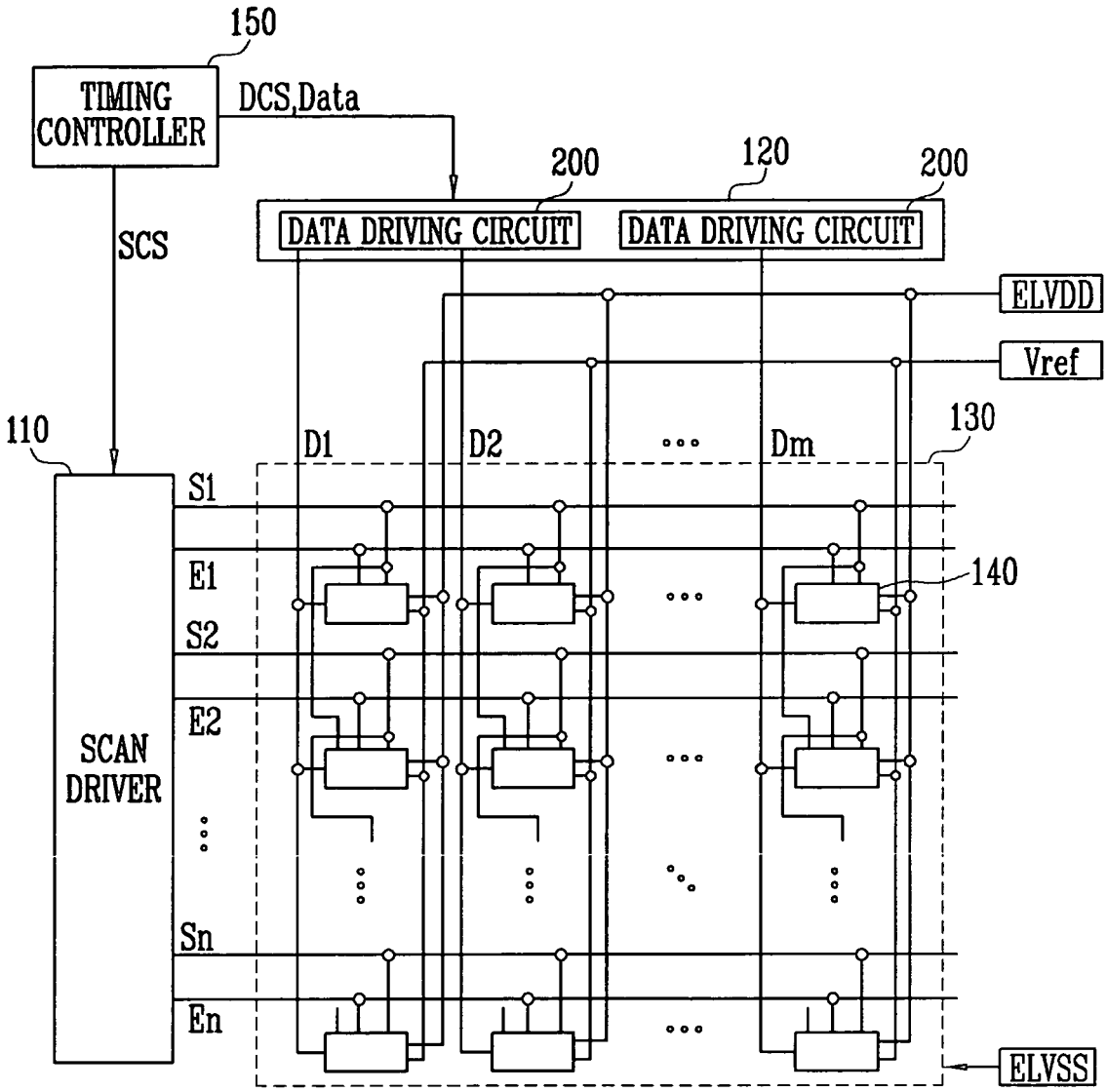
FIG. 2 is a view showing an organic light emitting display device according to a first embodiment of the present invention.

FIG. 2 is a view showing an organic light emitting display device according to an embodiment of the present invention.

With reference to FIG. 2, the organic light emitting display device according to a first embodiment of the present invention includes a display region 130, a scan driver 110, a data driver 120, and a timing controller 150. The display region 130 includes a plurality of pixels 140 that are coupled with scan lines S1 to Sn, light emitting control lines E1 to En, and data lines D1 to Dm. The scan driver 110 drives the scan lines S1 to Sn, and the light emitting control lines E1 to En. The data driver 120 drives the data lines D1 to Dm. The timing controller 150 controls the scan driver 110 and the data driver 120.

Figure 3:
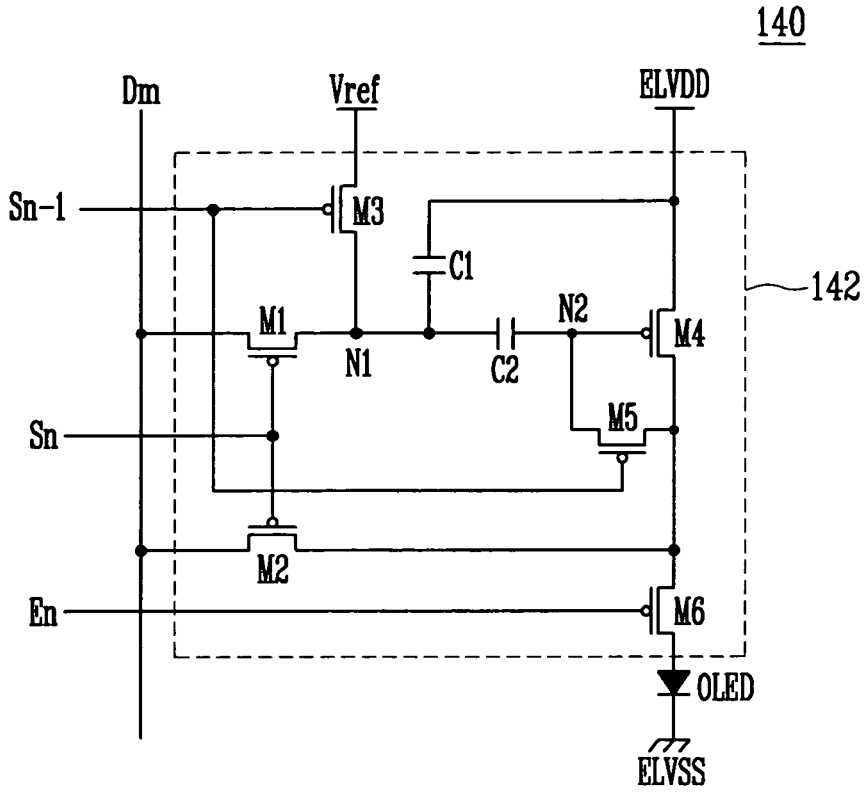
FIG. 3 is a circuit diagram showing an example of a pixel shown in FIG. 2.
Figure 5:
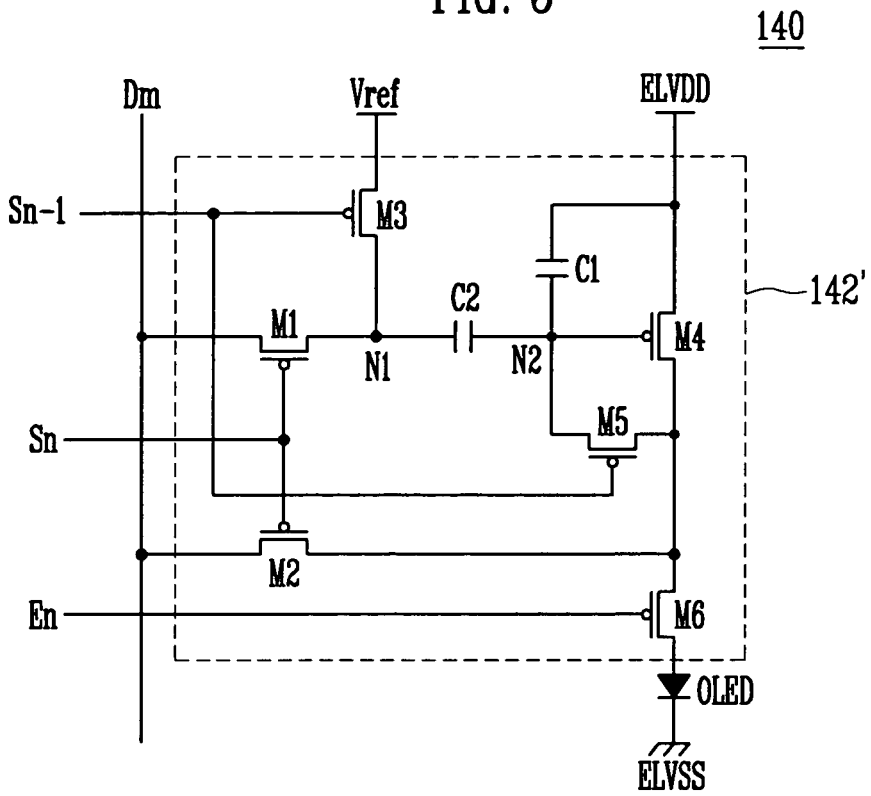
FIG. 5 is a circuit diagram showing another example of the pixel shown in FIG. 2.

The display region 130 has pixels 140 that are formed at an area divided by the scan lines S1 to Sn, the light emitting control lines E1 to En, and the data lines D1 to Dm. Each of the pixels 140 receives a first power of a first power supply EVVDD, a second power of a second supply ELVSS, and a reference power of a reference power supply Vref from an exterior. Upon receiving the reference power of the reference power supply Vref, each pixel 140 compensates for a voltage drop of the first power of the first power supply EVVDD using the first power supply EVVDD and the reference power supply Vref. Furthermore, each of the pixels 140 provides a predetermined electric current from the first power supply EVVDD to the second power supply ELVSS via an organic light emitting diode (not shown). For this purpose, each of the pixels 140 may be configured as shown in FIG. 3 or FIG. 5. A detailed construction of the pixel 140 shown in FIG. 3 or FIG. 5 will be described later.

The timing controller 150 generates a data drive control signal DCS and a scan drive control signal SCS corresponding to externally supplied synchronous signals. The data drive control signal DCS and the scan drive control signal SCS generated by the timing controller 150 are provided to the data driver 120 and the scan driver 110, respectively. Furthermore, the timing controller 150 provides externally supplied data Data to the data driver 120.

When the scan driver 110 receives the scan drive control signal SCS from the timing controller 150, it sequentially provides a scan signal to the scan lines S1 to Sn. Moreover, when the scan driver 110 receives the scan drive control signal SCS from the timing controller 150, it sequentially provides a light emitting signal to the light emitting control lines E1 to En. Here, the light emitting control signal is supplied to overlap with two corresponding scan signals. For this purpose, a width of the light emitting control signal is set to be identical with or greater than the scan signal.

The data driver 120 receives the data drive control signal DCS from the timing controller 150. Upon receiving the data drive control signal DCS, the data driver 120 generates the data signal, and provides it to the data lines D1 to Dm. Here, the data driver 120 supplies a predetermined current to data lines D1 to Dm during a first period of one (1) horizontal period H. In contrast to this, the data driver 120 supplies a predetermined voltage to the data lines D1 to Dm during a second period of the one (1) horizontal period H other than the first period. In order to do this, the data driver 120 includes at least one data driving circuit 200. A detailed construction of the data driving circuit 200 will be explained later. Hereinafter, in order to help the understanding of the present invention, the voltage supplied to the data lines D1 to Dm during the second period is referred to as the data signal.

FIG. 3 is a circuit diagram showing an example of the pixel 140 shown in FIG. 2. In order to help the understanding of the description thereof, FIG. 3 shows a pixel coupled with an m-th data line Dm, an (n−1)-th scan line Sn-1, an n-th scan line Sn, and an n-th light emitting control line En.

Referring to FIG. 3, the pixel 140 of the present invention includes a light emitting element OLED and a pixel circuit 142 for supplying a current to the light emitting element OLED.

The organic light emitting diode OLED generates light of a predetermined color according to the current from the pixel circuit 142. For this purpose, the organic light emitting diode OLED is formed by organic materials, phosphorescent materials, and/or inorganic materials.

When a scan signal is supplied to the (n−1)-th scan line Sn-1 (previous scan line), the pixel circuit 142 compensates for a voltage drop of the first power of the power supply ELVDD and a threshold voltage of the fourth transistor M4. Furthermore, when the scan signal is supplied to the n-th scan line Sn (current scan line), the pixel circuit 142 is charged with a voltage corresponding to the data signal. In order to perform these functions, the pixel circuit 142 includes first to sixth transistors M1 to M6, a first capacitor C1, and a second capacitor C2.

A first electrode of the first transistor M1 is coupled with the data line Dm, and a second electrode thereof is coupled with a first node N1. A gate electrode of the first transistor M1 is coupled with the n-th scan line Sn. When the scan signal is supplied to the n-th scan line Sn, the first transistor M1 is turned-on to electrically connect the data line Dm to the first node N1.

A first electrode of the second transistor M2 is coupled with the data line Dm, and a second electrode thereof is coupled with a second electrode of the fourth transistor M4. A gate electrode of the second transistor M2 is coupled with the n-th scan line Sn. When a scan signal is supplied to the n-th scan line Sn, the second transistor M2 is turned-on to electrically connect the second electrode of the fourth transistor M4 to the data line Dm.

A first electrode of the third transistor M3 is coupled with the reference power supply Vref, and a second electrode thereof is coupled with the first node N1. A gate electrode of the third transistor M3 is coupled with the (n−1)-th scan line Sn-1. When the scan signal is supplied to the (n−1)-th scan line Sn-1, the third transistor M3 is turned-on to electrically connect the first power supply ELVDD to the first node N1.

A first electrode of the fourth transistor M4 is coupled with the first power supply ELVDD, and a second electrode thereof is coupled with a first electrode of the sixth transistor M6. A gate electrode of the fourth transistor M4 is coupled with the second node N2. The fourth transistor M4 provides a current corresponding to a voltage applied to the second node N2, namely, a voltage charged in the first and second capacitors C1 and C2, to the first electrode of the sixth transistor M6.

A first electrode of the fifth transistor M5 is coupled with the second electrode of the fourth transistor M4, and a second electrode thereof is coupled with the second node N2. A gate electrode of the fifth transistor M5 is coupled with the (n−1)-th scan line Sn-1. When the scan signal is supplied to the (n−1)-th scan line Sn-1, the fifth transistor M5 is turned-on, causing the fourth transistor M4 to be diode-connected.

A first electrode of the sixth transistor M6 is coupled with the second electrode of the fourth transistor M4, and a second electrode thereof is coupled with an anode electrode of the light emitting element OLED. A gate electrode of the sixth transistor M6 is coupled with an n-th light emitting control line En. When a light emitting control signal is supplied to the n-th light emitting control line En, the sixth transistor M6 is turned-off, whereas when the light emitting control signal is not supplied to the n-th light emitting control line En, the sixth transistor M6 is turned-on. Here, the light emitting control signal supplied to the n-th light emitting control line En overlaps with the scan signal supplied to the (n−1)-th scan line Sn-1 and the n-th scan line Sn. Accordingly, when the scan signal is supplied to the (n−1)-th scan line Sn-1 and the n-th scan line Sn and a predetermined voltage is charged in the first and second capacitors C1 and C2, the sixth transistor M6 is turned-off. In other cases, the sixth transistor M6 is turned-on to electrically connect the fourth transistor M4 with the light emitting element OLED. In FIG. 3, although PMOS transistors M1 through M6 are shown, the types of the transistors are not limited thereto, and can be changed.

In addition, in the pixel 140 of FIG. 3, the reference power supply Vref does not supply an electric current to the organic light emitting diode OLED. That is, because the reference power supply Vref does not supply an electric current to pixels 140, a voltage drop of the reference power of the reference power supply 140 is not a concern. Accordingly, the same voltage can be maintained regardless of positions of the pixels 140. Here, a voltage value of the reference power supply Vref is set to be identical with or different from that of the first power supply ELVDD.

Figure 4:
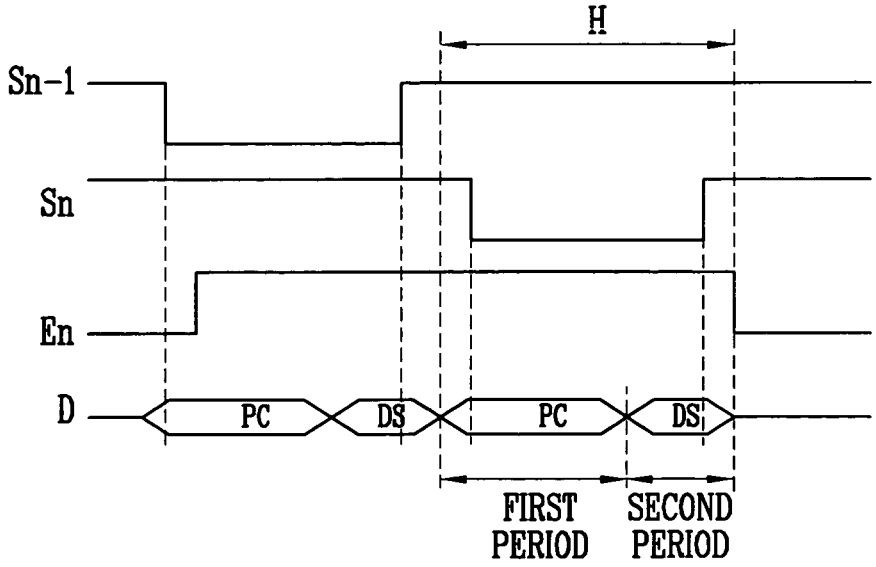
FIG. 4 is a waveform chart that illustrates a driving method of the pixel shown in FIG. 3.

FIG. 4 is a timing chart for illustrating a method for driving the pixel shown in FIG. 3. In FIG. 4, one (1) horizontal period H is divided into first and second periods. During the first period, a predetermined current PC flows through the data lines D1 to Dm. During the second period, a data signal DS is supplied to the data lines D1 to Dm. In practice, during the first period, the predetermined current PC is supplied from the pixel 140 to the data driving circuit 200 (current sink). During the second period, the data signal DS is supplied from the data driving circuit 200 to the pixel 140. Hereinafter, it is assumed that an initial voltage value of the reference power supply Vref and an initial voltage value of the first power supply ELVDD are set to be identical with each other.

Referring to FIG. 3 and FIG. 4, the scan signal is supplied to the n-th scan line Sn-1. When the scan signal is supplied to the n-th scan line Sn-1, both of the third transistor M3 and the fifth transistor M5 are turned-on. When the fifth transistor M5 is turned-on, the fourth transistor M4 is diode-connected. When the fourth transistor M4 is diode-connected, a voltage value obtained by subtracting a threshold voltage of the fourth transistor M4 from a voltage of the first power supply ELVDD, is applied to the second node N2.

Further, when the third transistor M3 is turned-on, a voltage of the reference power supply Vref is applied to the first node N1. At this time, a voltage corresponding to a difference between the first node N1 and the second node N2 is charged in a second capacitor C2. Assuming that a voltage value of the reference power supply Vref is identical with a voltage value of the first power supply ELVDD, a voltage corresponding to a threshold voltage of the fourth transistor M4 is charged in the second capacitor C2. Moreover, when a predetermined voltage drop occurs in the first power supply ELVDD, a threshold voltage of the fourth transistor M4 and a voltage corresponding to a voltage drop of the first power supply ELVDD are charged in the second capacitor C2. That is, in the present invention, while the scan signal is being supplied to the (n−1)-th scan line Sn-1, a threshold voltage of the fourth transistor M4 and a voltage corresponding to a voltage drop of the first power supply ELVDD are charged in the second capacitor C2, whereby a voltage drop of the first power supply ELVDD can be compensated for.

After a predetermined voltage is charged in the second capacitor C2, the scan signal is supplied to the n-th scan line Sn. When the scan signal is supplied to the n-th scan line Sn, the first transistor M1 and the second transistor M2 are turned-on. When the second transistor M2 is turned-on, the predetermined current PC from the pixel 140 is provided to the data driving circuit 200 via the data line Dm. In practice, the predetermined current PC is supplied to the data driving circuit 200 through the first power supply ELVDD, the fourth transistor M4, the second transistor M2, and the data line Dm. At this time, a predetermined voltage corresponding to the predetermined current PC is charged in the first capacitor C1 and the second capacitor C2.

In addition, the data driving circuit 200 resets a voltage of a gamma voltage unit (not shown) using the predetermined voltage (referred to as a compensation voltage hereinafter) generated when the predetermined current PC is sunk, and generates a data signal DS using the reset voltage of the gamma voltage unit. Next, during a second period of one (1) horizontal period, when the data signal DS is provided to the first node N1 via the first transistor M1, a voltage corresponding to a difference between the data signal DS and the first power supply ELVDD1 is charged in the first capacitor C1. At this time, since the second node N2 is set in a floating state, the second capacitor C2 maintains a previously charged voltage.

That is, according to the present invention, while a scan signal is being supplied to a previous scan line, the threshold voltage of the fourth transistor M4 and a voltage corresponding to a voltage drop of the first power supply ELVDD are charged in the second capacitor C2, thereby causing the threshold voltage of the fourth transistor M4 and the voltage drop of the first power supply ELVDD to be compensated for. Furthermore, the present invention resets a voltage of a gamma voltage unit and supplies a generated data signal using the rest voltage of the gamma voltage unit while the scan signal is being supplied to a current scan line, so that the mobility of transistors included in the pixel 140 can be compensated for. Therefore, the present invention compensates for non-uniformity of a threshold voltage of the transistor and mobility in order to display uniform image. A method of resetting the voltage of the gamma voltage unit will be explained below.

FIG. 5 is a circuit diagram showing another example of the pixel 140 shown in FIG. 2 that includes a pixel circuit 142'. Except that the first capacitor C1 is installed between the second node N2 and the first power supply ELVDD, the pixel circuit 142' of FIG. 5 has substantially the same construction as that of the pixel circuit 142 shown in FIG. 3.

Referring to FIG. 4 and FIG. 5, a scan signal is supplied to the n-th scan line Sn-1. When the scan signal is supplied to the n-th scan line Sn-1, both of the third transistor M3 and the fifth transistor M5 are turned-on. When the fifth transistor M5 is turned-on, the fourth transistor M4 is diode-connected. When the fourth transistor M4 is diode-connected, a voltage value obtained by subtracting a threshold voltage of the fourth transistor M4 from a voltage of the first power supply ELVDD, is applied to the second node N2.

Further, when the third transistor M3 is turned-on, a voltage of the reference power supply Vref is applied to the first node N1. Accordingly, a voltage corresponding to a difference between a voltage of the first node N1 and a voltage of the second node N2 is charged in the second capacitor C2. Here, while the scan signal is being supplied to the (n−1)-th scan line Sn-1, because the first transistor M1 and the second transistor M2 are turned-off, the data signal DS is not provided to the pixel 140.

When the scan signal is supplied to the n-th scan line Sn, the first transistor M1 and the second transistor M2 are turned-on. When the second transistor M2 is turned-on, the predetermined current PC from the pixel 140 is provided to the data driving circuit 200 via the data line Dm. In practice, the predetermined current PC is supplied to the data driving circuit 200 through the first power supply ELVDD, the fourth transistor M4, the second transistor M2, and the data line Dm. At this time, a predetermined voltage corresponding to the predetermined current PC is charged in the first capacitor C1 and the second capacitor C2.

In addition, the data driving circuit 200 resets a voltage of a gamma voltage unit (not shown) using the predetermined voltage (referred to as a compensation voltage hereinafter) generated when the predetermined current PC is sunk, and generates a data signal DS using the reset voltage of the gamma voltage unit. Next, during a second period of one (1) horizontal period, when the data signal DS is provided to the first node N1 via the first transistor M1, a predetermined voltage corresponding to the data signal DS is charged in the first capacitor C1 and the second capacitor C2.

In practice, when the data signal DS is supplied, a voltage of the first node N1 drops from the voltage of the reference power supply Vref to a voltage of the data signal DS. At this time, since the second node N2 is in a floating state, the voltage value of the second node N2 drops to correspond to a voltage drop amount of the first node N1. In this case, a voltage drop in the second node N2 is determined by capacities (or capacitances) of the first capacitor C1 and the second capacitor C2.

When a voltage of the second node N2 drops, a predetermined voltage is charged in the first capacitor C1 corresponding to a voltage value of the second node N2. Here, because the reference power supply Vref has a fixed voltage value, a charge voltage of the first capacitor C1 is determined by the data signal DS. In other words, since the charge voltage of the first capacitor C1 is determined by the reference power supply Vref and the data signal DS, a desired voltage may be charged in the pixel 140 shown in FIG. 5 regardless of a voltage drop in the first power supply ELVDD.

In addition, the present invention resets a voltage of a gamma voltage unit and supplies a generated data signal using the rest voltage of the gamma voltage unit while the scan signal is being supplied to a current scan line, so that the mobility of transistors included in the pixel 140 can be compensated for. Therefore, the present invention compensates for non-uniformity of a threshold voltage of the transistor and mobility in order to display a uniform image.

Figure 6:
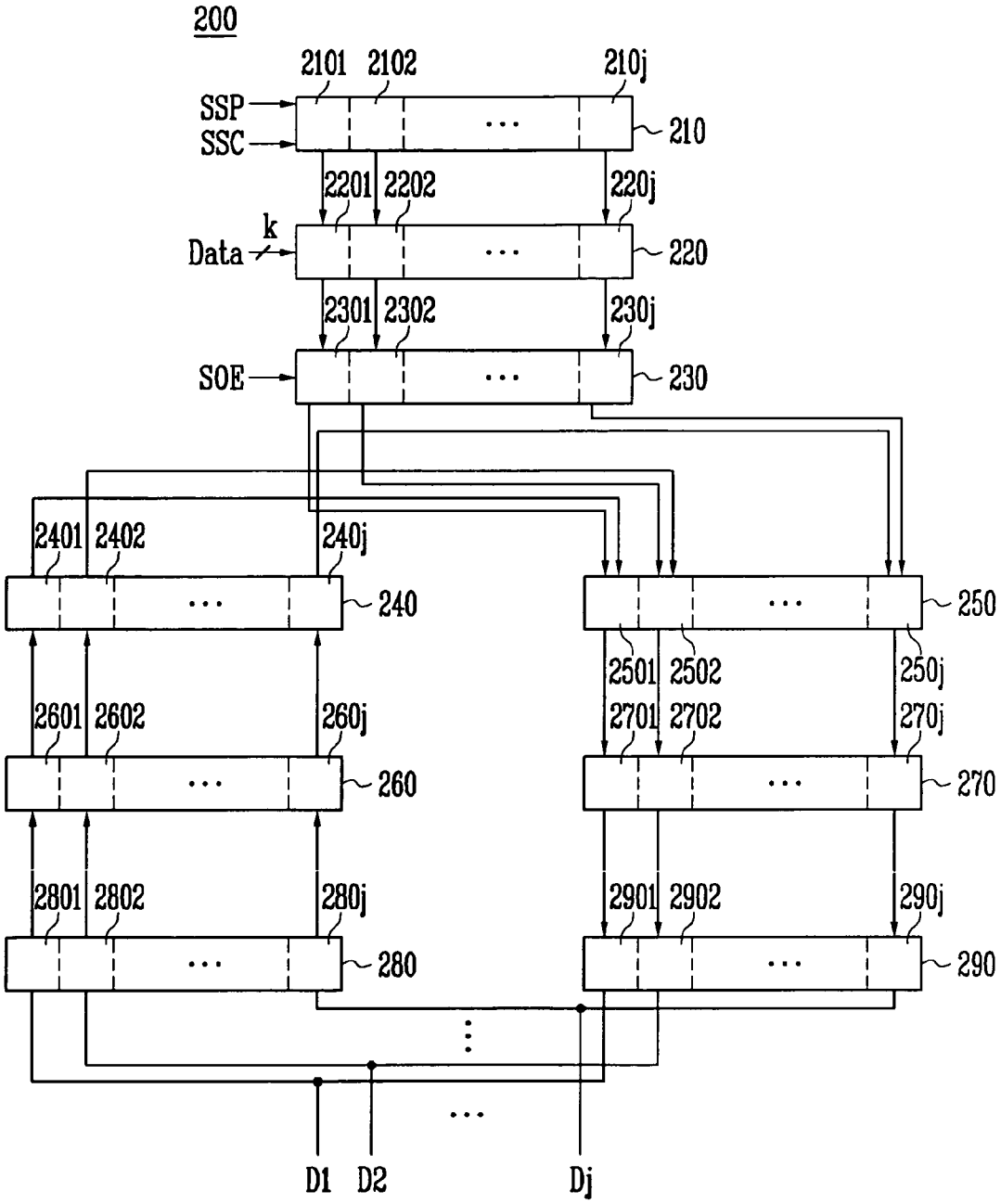
FIG. 6 is a block diagram showing an example of a data driving circuit shown in FIG. 2.

FIG. 6 is a block diagram showing an example of the data driving circuit shown in FIG. 2. In order to help the understanding of the data driving circuit, in FIG. 6, it is assumed that a data driving circuit 200 has j (j is a natural number greater than 2) channels.

Referring to FIG. 6, the data driving circuit 200 includes a shift register 210, a sampling latch 220, a holding latch 230, a gamma voltage unit 240, a digital-analog converter (referred to as DAC hereinafter) 250, a first buffer unit 270, a second buffer unit 260, a current supply unit 280, and a selector 290.

The shift register 210 receives a source shift clock SSC and a source start pulse SSP from the timing controller 150. When the shift register 210 receives a source shift clock SSC and a source start pulse SSP, it sequentially generates j sampling signals while shifting the source start pulse SSP every one period of the source shift clock SSC. In order to do this, the shift register 210 includes j shift registers 2101 to 210j.

The sampling latch 220 sequentially stores data Data in response to the sampling signals sequentially supplied from the shift register section 210. Here, the sampling latch section 220 includes j sampling latches 2201 to 220j for storing j data Data. Furthermore, each of the sampling latches 2201 to 220j has a size corresponding to the bit number of the data Data. For example, when the data Data is formed by k bits, the sampling latches 2201 to 220i are set to have k bit size.

When a source output enable signal SOE is inputted to the holding latch section 230, the holding latch 230 receives and stores the data Data from the sampling latch section 220. Moreover, when a source output enable signal SOE is inputted to the holding latch 230, the holding latch 230 supplies data Data stored therein to the DAC 250. So as to perform this operation, the holding latch 230 includes j holding latches 2301 to 230j set by k bits. Each of the holding latches 2301 to 230j has a size corresponding to the bit number of data. For example, each of the holding latches 2301 to 230j is set by k bits so that data may be stored therein.

Figure 8:
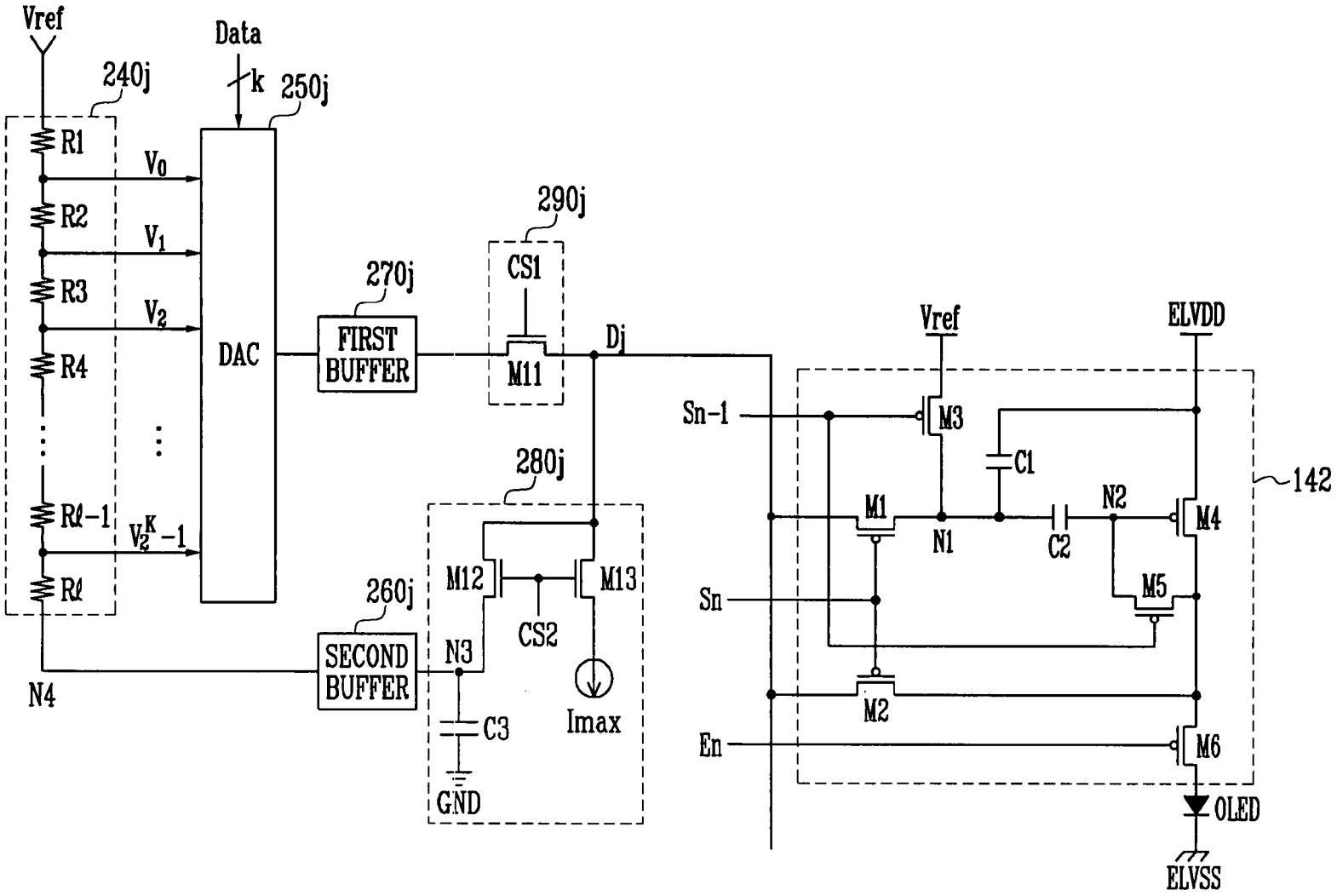
FIG. 8 is a view showing an example of a connected relation of a voltage generator, a digital-analog converter, a first buffer, a second buffer, a switching unit, a current sink unit, and a pixel shown in FIG. 6.

The gamma voltage unit 240 includes j voltage generators 2401 to 240j that generate a predetermined data voltage corresponding to data of k bits. As shown in FIG. 8, each of the j voltage generators 2401 to 240j is composed of a plurality of voltage division resistors R1 to Rl, and generates $2^k$ data voltages. Here, each of the j voltage generators 2401 to 240j resets voltage values of data voltages using a compensation voltage supplied from the second buffer unit 260, and provides the reset data voltages to DACs 2501 to 2501j.

The DAC 250 includes j DACs 2501 to 250j for generating a data signal DS in response to a digital value of the data. Each of the j DACs 2501 to 250j selects one of a plurality of data voltages corresponding to a digital value of data supplied from the holding latch 230, and generates the data signal DS.

The first buffer unit 270 provides the data signal DS supplied from the DAC 250 to the selector 290. In order to perform the function, the first buffer unit 270 includes j buffers 2701 to 270j.

The selector 290 controls electric connections between the data lines D1 to Dj and the first buffers 2701 to 270j. In practice, the selector 290 electrically connects the first buffers 2701 to 270j to the data lines D1 to Dj during only the second period of one (1) horizontal period, but does not electrically connect the first buffers 2701 to 270j to the data lines D1 to Dj during remaining periods of the one (1) horizontal period. For this purpose, the selector 290 includes j switches 2901 to 290j.

The current supply unit 280 sinks a predetermined current PC from the pixels 140 coupled with the data lines D1 to Dj during the first period of the one (1) horizontal period. In practice, the current supply unit 280 sinks a maximum current to flow through each pixel 140, namely, an electric current to be supplied to the organic light emitting diode OLED when the pixel 140 emits light of the greatest brightness. Moreover, the current supply unit 280 provides a predetermined compensation voltage generated when the electric current is sunk to the second buffer unit 260. In order to do this, the current supply unit 280 includes j current sink units 2801 to 280j.

The second buffer unit 260 provides a compensation voltage supplied from the current supply unit 280 to the gamma voltage unit 240. So as to perform the operation, the second buffer unit 260 includes second j buffers 2601 to 260j.

Figure 7:
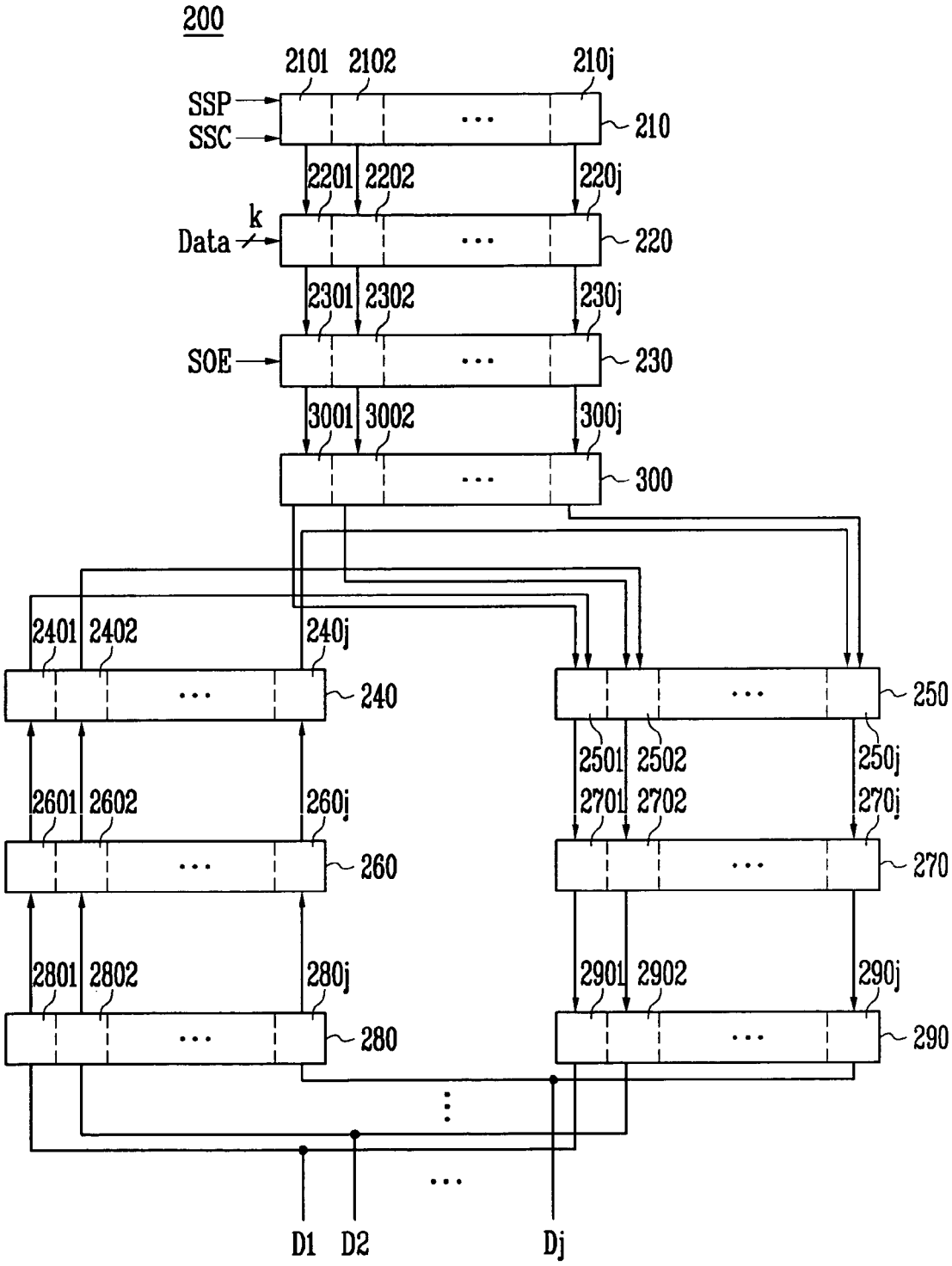
FIG. 7 is a block diagram showing another example of the data driving circuit shown in FIG. 2.

On the other hand, as shown in FIG. 7, the data driving circuit 200 of a second embodiment of the present invention further includes a level shifter 300 connected to (or installed at a next stage of) the holding latch 230. The level shifter 300 increases a voltage level of data supplied from the holding latch 230, and provides the data having the increased voltage level to the DAC 250. When data having a higher voltage level from an external system is supplied to the data driving circuit 200, a circuit component having high resisting potential according to the voltage level should be installed, thereby causing an increase in a manufacturing cost. Accordingly, in FIG. 7, data having a lower voltage level is supplied to the data driving circuit 200 from an, external system. The level shifter 300 boosts the data having a lower voltage level to a higher voltage level such that the circuit component having high resisting potential is not needed.

FIG. 8 is a view showing an example of a connected relation of a voltage generator, a digital-analog converter, a first buffer, a second buffer, a switching unit, a current sink unit, and a pixel shown in FIG. 6. So as to help the understanding of the voltage generator, the digital-analog converter, the first buffer, the second buffer, the switching unit, the current sink unit, and the pixel, it is assumed that a j-th channel is shown in FIG. 8 and the data line Dj is coupled with the pixel circuit 142 shown in FIG. 3.

With reference to FIG. 8, the voltage generator 240j includes a plurality of voltage division resistors R1 to Rl. The voltage division resistors R1 to Rl. divide between a voltage of the reference power supply Vref and a compensation voltage supplied from the second buffer unit 260j to generate a plurality of data voltages V0 to V$2^k$−1. The generated data voltages V0 to V$2^k$−1 are provided to the DAC 250j.

The DAC 250j selects and provides one of the data voltages V0 to V$2^k$−1 to the first buffer 270j. Here, the data voltage selected by the DAC 250j is used as the data signal DS.

The first buffer 270j transfers the data signal DS supplied from the DAC 250j to the switch 290j.

The switch 290j includes an eleventh transistor M11. The eleventh transistor M11 is controlled by a first control signal CS1 shown in FIG. 9. That is, the eleventh transistor M11 is turned-on during the second period of one (1) horizontal period H and turned-off during the first period. Accordingly, the data signal DS is provided to the data line Dj during the second period of one (1) horizontal period H, but is not provided thereto during remaining periods.

The current sink unit 280j includes a twelfth transistor M12, a thirteenth transistor M13, a current source Imax, and a third capacitor C3. The twelfth transistor M12 and the thirteenth transistor M13 are controlled by a second control signal CS2. The current source Imax is coupled with a first electrode of the thirteenth transistor M13. The third capacitor C3 is coupled between a third node N3 and a ground voltage source GND.

A gate electrode of the twelfth transistor M12 is coupled with a gate electrode of the thirteenth transistor M13, and a second electrode thereof is coupled with a second electrode of the thirteenth transistor M13 and the data line Dj. Moreover, a first electrode of the twelfth transistor M12 is coupled with the second buffer 260j. The twelfth transistor M12 is turned-on during the first period of one (1) horizontal period and turned-off during the second period according to the second control signal CS.

The gate electrode of the thirteenth transistor M13 is coupled with the gate electrode of the twelfth transistor M12, and the second electrode thereof is coupled with the data line Dj. Furthermore, a first electrode of the thirteenth transistor M13 is coupled with the current source Imax. The thirteenth transistor M13 is turned-on during the first period of one (1) horizontal period and turned-off during the second period according to the second control signal CS.

The current source Imax receives an electric current from the pixel circuit 142 to be supplied to the organic light emitting diode OLED when the pixel 140 emits light of the greatest brightness during the first period. The first period is a period during which the twelfth transistor M12 and the thirteenth transistor M13 are turned-on.

When an electric current is sunk from the pixel 140 by the current source Imax, a compensation voltage applied to the third node N3 is stored in the third capacitor C3. In practice, the third capacitor C3 charges the compensation voltage applied to the third node N3 during the first period. Although the twelfth transistor M12 and the thirteenth transistor M13 are turned-off, the third capacitor C3 maintains the compensation voltage of the third node N3.

When the second buffer 260j provides the compensation voltage applied to the third node N3, namely, the voltage charged in the third capacitor C3, the voltage generator 240j divides a voltage between the reference power supply Vref and the compensation voltage from the second buffer 260j. Here, in the pixels 140, the compensation voltages applied to the third node N3 can be set to be identical or different according to mobility of the transistors included in each of the pixels 140. In practice, the compensation voltage supplied to j voltage generators 2401 to 240j is determined by a current coupled pixel 140.

In addition, if different compensation voltages are supplied to the j voltage generators 2401 to 240j, the data voltages V0 to V$2^k$−1 supplied to DAC 2501 to 250j installed every j channel are differently set. Since each of the data lines D1 to Dj is controlled by the current coupled pixel 140, although the mobility of the transistors included in the pixel 140 may be different, the data voltages V0 to V$2^k$−1 may still display a uniform image in the pixel 140.

Figure 9:
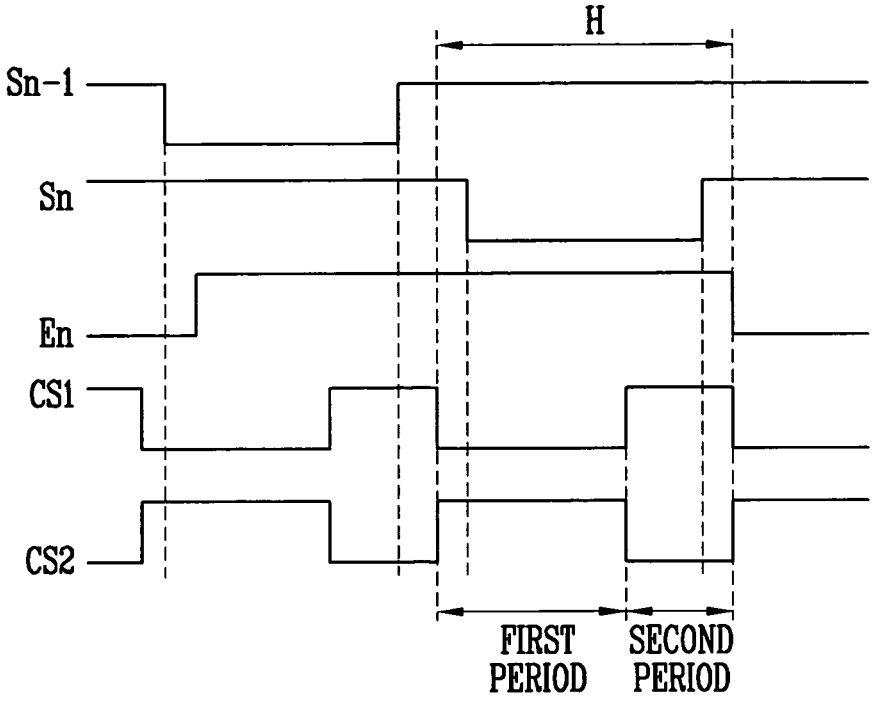
FIG. 9 is a waveform chart showing a method for driving the switching unit, the current sink unit, and the pixel shown in FIG. 8.

FIG. 9 is a waveform chart showing a method for driving the switching unit, the current sink unit, and the pixel circuit 142 shown in FIG. 8.

A voltage value of the data signal DS supplied to the pixel 140 will be explained in detail by reference to FIG. 8 and FIG. 9. A scan signal is first provided to the (n−1)-th scan line Sn-1. When the scan signal is first provided to the (n−1)-th scan line Sn-1, the third transistor M3 and the fifth transistor M5 are turned-on. Accordingly, a voltage value obtained by subtracting a threshold voltage of the fourth transistor M4 from the voltage of the first power supply ELVDD is applied to the second node N2, and a voltage of the reference power supply Vref is applied to the first node N1. A voltage corresponding to a voltage drop of the first power supply ELVDD and the threshold voltage of the fourth transistor M4 are charged in the second capacitor C2.

In practice, the voltages applied to the first node N1 and the second node N2, respectively may be expressed by following equations 1 and 2.

$$V_{N1}=Vref \tag{1}$$

$$V_{N2}=ELVDD-|V_{thM4}| \tag{2}$$

where, $V_{N1}$ is a voltage applied to the first node N1, $V_{N2}$ is a voltage applied to the second node N2, and $V_{thM4}$ is a threshold voltage of the fourth transistor M4.

During a period between a first time when the scan signal is not supplied to the (n−1)-th scan line Sn-1 and a second time when the scan signal is supplied to the n-th scan line, the first node N1 and the second node N2 are set in a floating state. Consequently, the voltage value charged in the second capacitor C2 is unchanged.

Next, the scan signal is provided to the n-th scan line Sn to turn-on the first transistor M1 and the second transistor M2. During the first period of a supply period of the scan signal to the n-th scan line Sn, the twelfth transistor M12 and the thirteenth transistor M13 are turned-on. When the twelfth transistor M12 and the thirteenth transistor M13 are turned-on, an electric current of the current source Imax is sunk via the first power supply ELVDD, the fourth transistor M4, the second transistor M2, the data line Dj, and the thirteenth transistor M13.

At this time, because the electric current of the current source Imax flows through the fourth transistor M4, it may be expressed by a following equation 3.

$$Imax=\frac{1}{2}\mu_P Cox\frac{W}{L}(ELVDD-V_{N2}-|V_{thM4}|)^2 \tag{3}$$

where, μ represents a mobility, Cox represents a capacity of an oxide layer, W represents a channel width, and L represents a channel length.

When the electric current of the equation 3 flows through the fourth transistor M4, a voltage applied to the second node N2 may be expressed by a following equation 4.

$$V_{N2}=ELVDD-\sqrt{\frac{2Imax}{\mu_P Cox}\frac{L}{W}}-|V_{thM4}| \tag{4}$$

In addition, a voltage applied to the first node N1 is expressed by a following equation 5 according to a coupling of the second capacitor C2.

$$V_{N1}=Vref-\sqrt{\frac{2Imax}{\mu_P Cox}\frac{L}{W}}=V_{N3}=V_{N4} \tag{5}$$

where, the first voltage $V_{N1}$ applied to the first node N1 is set to be identical with the third voltage $V_{N3}$ applied to the third node N3 and the fourth voltage $V_{N4}$ applied to the fourth node N4. That is, when an electric current is sunk by the current source Imax, a voltage expressed by the equation 5 is applied to the fourth node N4.

On the other hand, voltages applied to the third node N3 and the fourth transistor N4 may be affected by the mobility of transistors included in the pixel 140 in which a current electric current is sunk as indicated in equation 5. Accordingly, when the electric current is sunk by the current source Imax, voltages applied to the third node N3 and the fourth transistor N4 may be differently set according to respective pixels 140 (in a case of different mobility).

Also, when the voltage embodied by the equation 5 is applied to the fourth node N4, a voltage Vdiff of the voltage generator 240j may be expressed by a following equation 6.

$$Vdiff = Vref - \left(Vref - \sqrt{\frac{2Imax}{\mu_P Cox}\frac{L}{W}}\right) \tag{6}$$

In addition, when an h (h is a natural number less than an f, which is also a natural number) data voltage is selected among f data voltages in the DAC 250j, a voltage Vb supplied to the first buffer 270j may be expressed by a following equation 7.

$$Vb = Vref - \frac{h}{f}\sqrt{\frac{2Imax}{\mu_P Cox}\frac{L}{W}} \tag{7}$$

Also, after the electric current is sunk to charge the voltage of the equation 7 in the third capacitor C3 during the first period, the twelfth transistor M12 and the thirteenth transistor M13 are turned-off during the second period, and the eleventh transistor M11 is turned-on. At this time, the third capacitor C3 maintains a voltage value charged therein. Accordingly, a voltage value of the third node N3 may have a value of the equation 5.

Moreover, since the eleventh transistor M11 is turned-on, the voltage supplied to the first buffer 270j is provided to the first node N1 via the eleventh transistor M11, the data line Dj, and the first transistor M1. That is, a voltage of the equation 7 is provided to the first node N1. Furthermore, a voltage applied to the second node N2 may be expressed by a following equation 8 by a coupling of the second capacitor C2.

$$V_{N2} = ELVDD - \frac{h}{f}\sqrt{\frac{2Imax}{\mu_P C_{OX}}\frac{L}{W}} - |V_{thM4}| \tag{8}$$

At this time, an electric current flowing through the fourth transistor M4 may be expressed by a following equation 9.

$$I_{N4} = \frac{1}{2}\mu_P C_{OX}\frac{W}{L}(ELVDD - V_{N2} - |V_{thM4}|)^2 \tag{9}$$

$$\frac{1}{2}\mu_P C_{OX}\frac{W}{L}\left(ELVDD - \left(ELVDD - \frac{h}{f}\sqrt{\frac{2Imax}{\mu_P C_{OX}}\frac{L}{W}} - |V_{thM4}|\right) - V_{thM4}\right)^2$$

-continued $$\left(\frac{h}{f}\right)^2 Imax$$

With reference to the equation 9, an electric current flowing through the fourth transistor is determined by a data voltage generated by the voltage generator 240j in the present invention. Namely, according to the present invention, the electric current determined by the data voltage flows through the fourth transistor M4 regardless of a threshold voltage of the fourth transistor M4 and the mobility, and accordingly a uniform image may be displayed.

Figure 10:
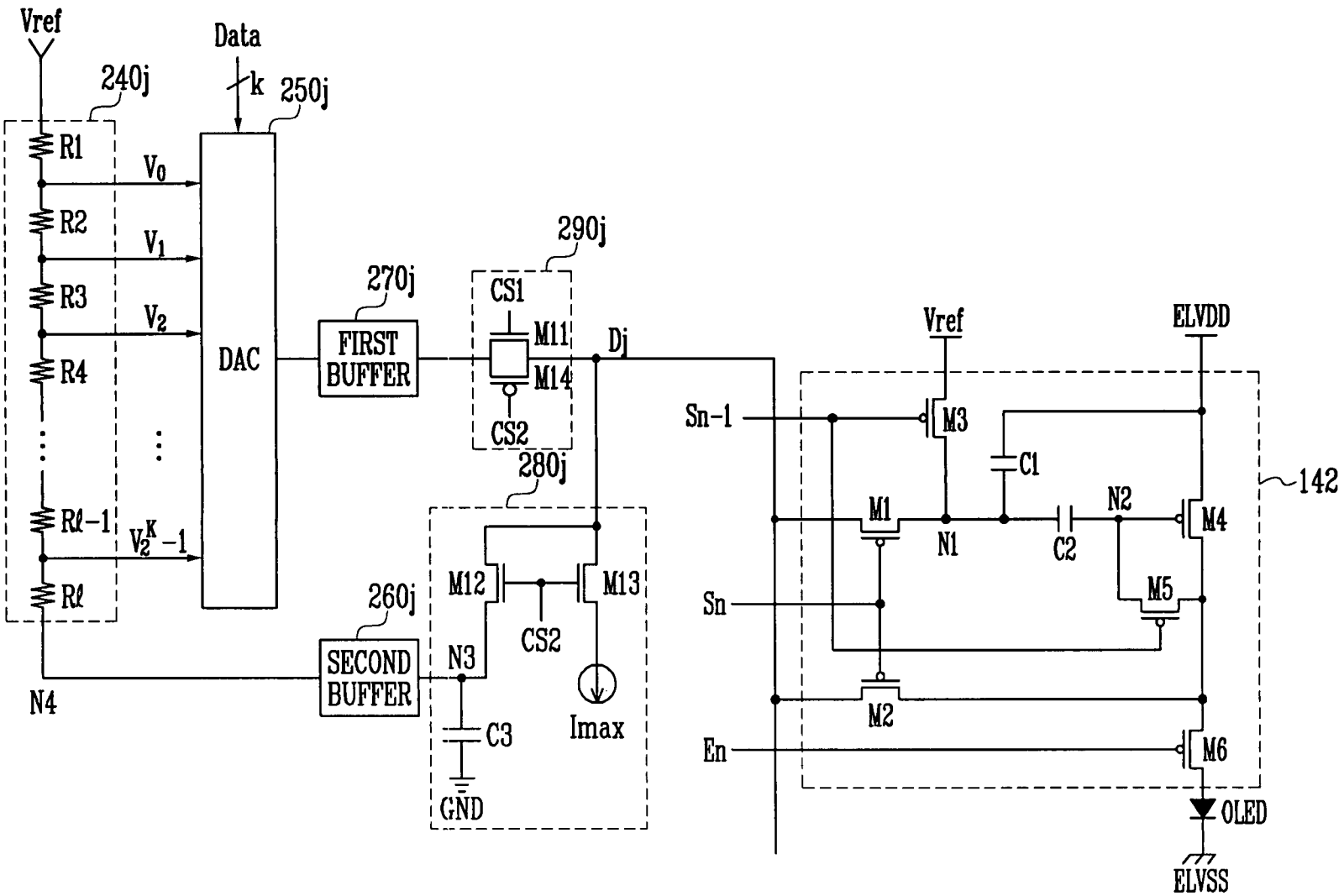
FIG. 10 is a view showing another example of the switching unit shown in FIG. 8.

On the other hand, a construction of the switch 290j according to the present invention may be variously designed. For example, as shown in FIG. 10, the switch 290j includes the eleventh transistor M11 and a fourteenth transistor M14 coupled with each other in a transmission gate form. The eleventh transistor M11 is of NMOS type and receives the first control signal CS1, whereas the fourteenth transistor M14 is of PMOS type, and receives the second control signal CS2. Here, since the first control signal CS1 and the second control signal CS2 have polarities opposite to each other, the eleventh transistor M11 and the fourteenth transistor M14 are turned-on and turned-off at the same time, respectively.

Also, when the eleventh transistor M11 and the fourteenth transistor M14 are coupled with each other in the transmission gate form, a voltage-current characteristic curve has an approximately straight line that allows a switching error to be minimized.

Figure 11:
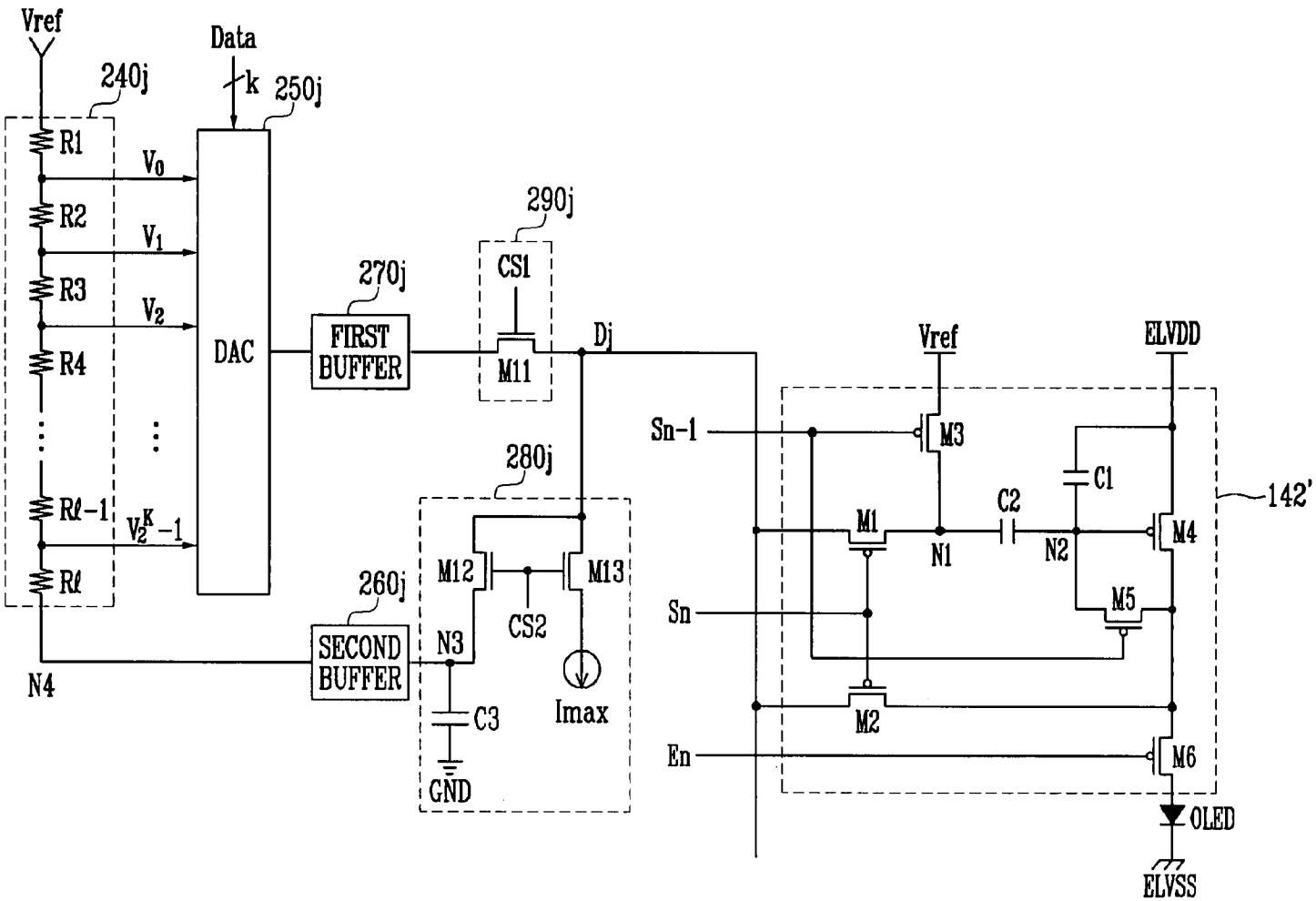
FIG. 11 is a view showing another example of a connected relation of the voltage generator, the digital-analog converter, the first buffer, the second buffer, the switching unit, the current sink unit, and the pixel shown in FIG. 6.

FIG. 11 is a view showing another example of a connected relation of a voltage generator, a digital-analog converter, a first buffer, a second buffer, a switching section, a current sink section, and a pixel shown in FIG. 6. Except for a pixel circuit 142' coupled with the data line Dj changes, all arrangements of FIG. 11 are substantially identical with those of FIG. 8. Accordingly, a voltage supplied to the pixel circuit 142' will be described further below.

With reference to FIG. 9 and FIG. 11, when the scan signal is first provided to the (n−1)-th scan line Sn-1, the voltages expressed by the equations 1 and 2 are applied to the first node N1 and the second node N2.

Next, when the scan signal is provided to the n-th scan line Sn, during the first period when the twelfth transistor M12 and the thirteenth transistor M13 are turned-on, an electric current flowing through the fourth transistor M4 is expressed by the equation 3, and the voltage applied to the second node N2 is expressed by the equation 4. In addition, by a coupling of the second capacitor C2, the voltage applied to the first node N1 may be expressed by a following equation 10.

$$\begin{aligned} V_{N1} &= Vref - \left(\frac{C1 + C2}{C2}\right)\sqrt{\frac{2Imax}{\mu_P C_{ox}}\frac{L}{W}} \\ &= V_{N3} \\ &= V_{N4} \end{aligned} \tag{10}$$

Moreover, because the voltage applied to the first node N1 is provided to the second node N2 and the third node N3, the voltage Vdiff of the voltage generator 240j may be expressed by a following equation 11.

$$V_{diff} = Vref - \left(Vref - \left(\frac{C1 + C2}{C2}\right)\sqrt{\frac{2Imax}{\mu_p C_{OX}}\frac{L}{W}}\right) \quad (11)$$

Furthermore, when the h-th data voltage is selected from f data voltages in the DAC 250j, the voltage Vb supplied to the first buffer 270j may be expressed by a following equation 12.

$$Vb = Vref - \frac{h}{f}\left(\frac{C1 + C2}{C2}\right)\sqrt{\frac{2Imax}{\mu_p C_{OX}}\frac{L}{W}} \quad (12)$$

The voltage supplied to the first buffer 270j is provided to the first node N1. At this time, the voltage applied to the second node N2 may be expressed by the equation 8. Consequently, an electric current flowing through the fourth transistor M4 may be expressed by the equation 9. That is, according to the present invention, the electric current supplied to the organic light emitting diode OLED through the fourth transistor M4 is determined by a data voltage regardless of a threshold voltage of the fourth transistor M4 and the mobility, so that a uniform image can be displayed.

On the other hand, as shown in FIG. 5, in the pixel circuit 142, although a voltage of the first node N1 greatly changes, a voltage of the second node N2 slowly changes, that is, C1+C2/C2. Accordingly, the case where the pixel 140 shown in FIG. 5 is used, the pixel circuit 142 can set a voltage range of the voltage generator 240j wider than that of the case where the pixel circuit 142 shown in FIG. 3 is used. As described above, when the voltage range of the voltage generator 240j is set to have a wide voltage range, an influence of the eleventh transistor M11 and the first transistor M1 due to a switching error can be reduced.

On the other hand, the description of FIG. 8 and FIG. 11 is an ideal case without considering a load of the data lines Dj. In practice, when a predetermined current PC is sunk, a voltage value applied to the first node N1 and the third node N3 is set differently according to a voltage drop of the data line Dj. That is, when a predetermined current PC is sunk, the voltage value of the third node N3 is set lower than that of the first node N1 according to the voltage drop of the data line Dj, whereby an image of a desired data cannot be displayed.

In an enhancement of the above described embodiments, a compensation voltage applied to the third node N3 is boosted by a voltage corresponding to a voltage drop of the data line Dj. An arrangement for compensating for a voltage corresponding to a voltage drop of the data line Dj by installing a boosting unit at the data driving circuit 200 is disclosed in patent application entitled "Data Driving Circuit and Driving Method of Light Emitting Display Using the Same" filed in the United States Patent and Trademark Office on the same date as the present application, and the entire content of which is incorporated herein by reference. As such, embodiments of the present invention include an apparatus for supplying a voltage corresponding to a voltage drop of the data line Dj to the boosting unit.

Figure 12:
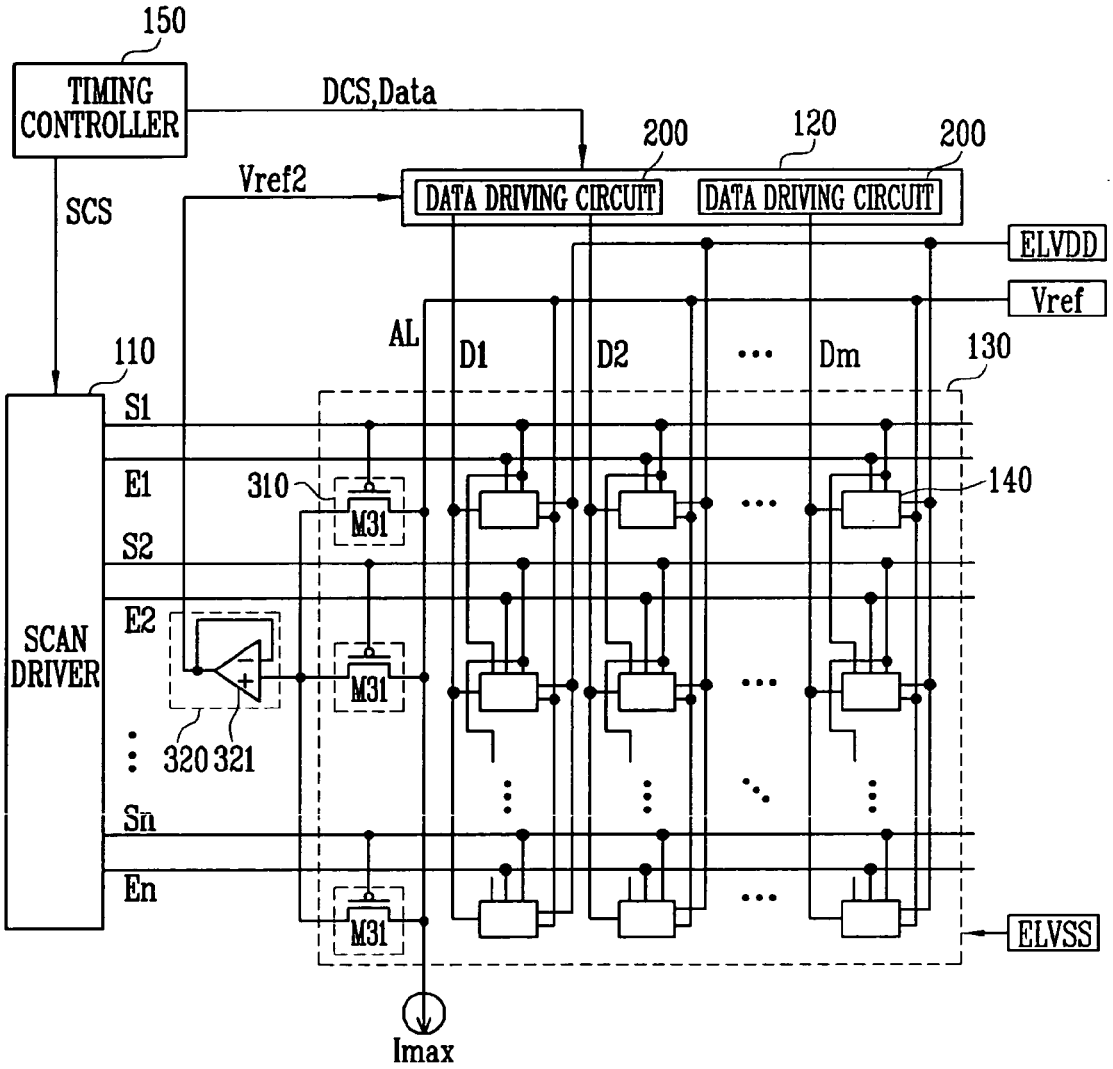
FIG. 12 is a view showing an organic light emitting display device according to a second embodiment of the present invention.
Figure 13:
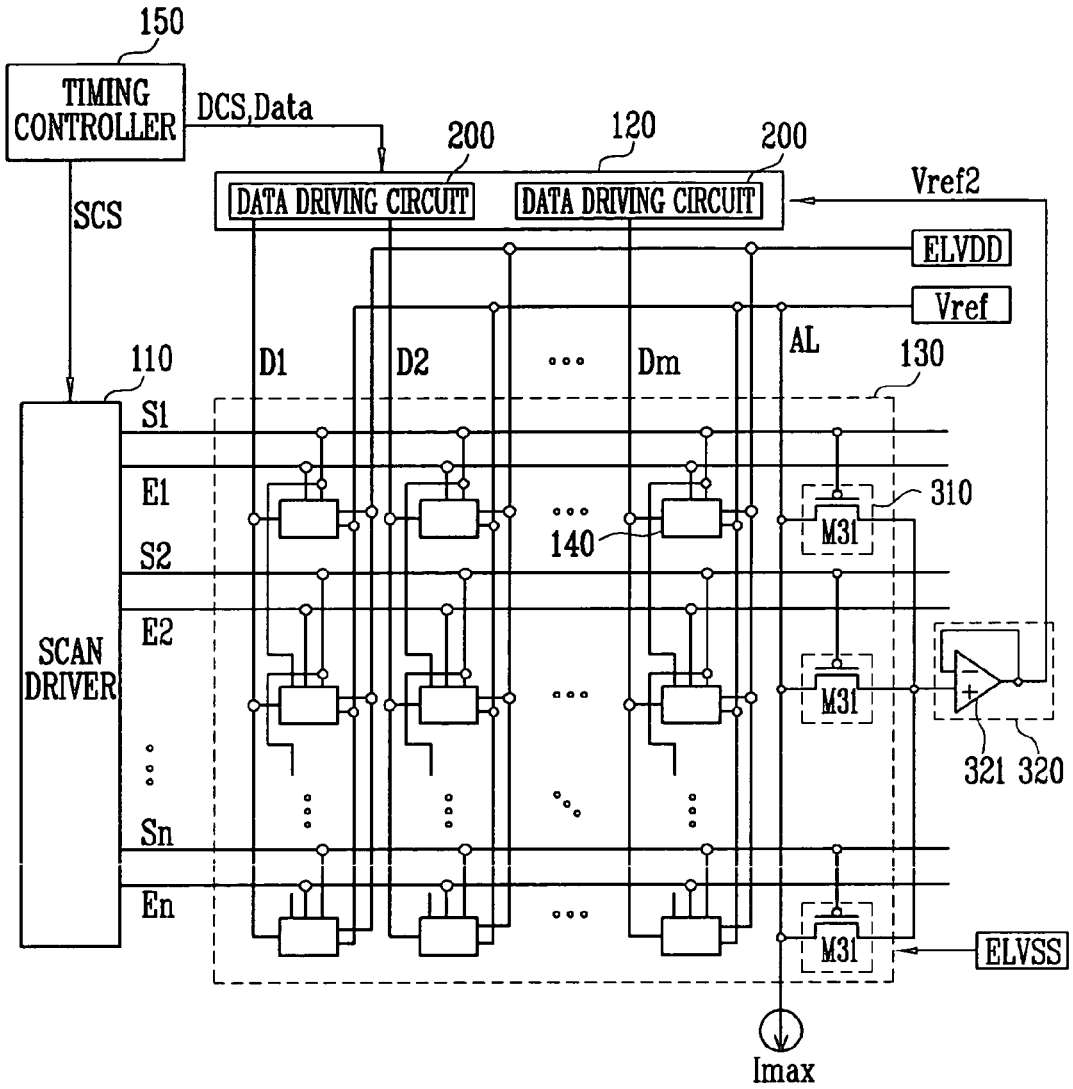
FIG. 13 is a view showing an organic light emitting display device according to a third embodiment of the present invention in which an auxiliary line is positioned at a location different from that of the auxiliary line of FIG. 12.

FIGS. 12 and 13 respectively are views showing an organic light emitting display device according to a second embodiment and a third embodiment of the present invention. In each of FIGS. 12 and 13, elements that are substantially the same as those shown in FIG. 2 are allotted the same reference numerals, and the description of the same elements will be omitted.

Referring to FIG. 12, the organic light emitting display device according to the second embodiment of the present invention includes an auxiliary line AL, connectors 310, and voltage transfer units 320. The auxiliary line AL is formed parallel to the data lines D1 through Dm. The connectors 310 are formed at respective crossing parts of the auxiliary line AL and the scan lines S1 to Sn. The voltage transfer units 320 are coupled between the connectors 310 and the data driving circuit 120.

The auxiliary line AL is formed at the display region 130 to have the same (or similar) width and thickness as those of the data lines D1 to Dm. One side of the auxiliary line AL is coupled with a first reference power supply Vref and another side thereof is coupled with a current source Imax. When a pixel 140 emits light of a maximal brightness, the current source Imax receives an electric current which is flown into the organic light emitting diode OLED, from the first reference power supply Vref via the auxiliary line AL. On the other hand, the auxiliary line AL is formed at a specific position of the display region 130 parallel to the data lines D1 to Dm. For example, the auxiliary line AL may be formed at a left edge of the display region 130 as shown in FIG. 12 or at a right edge thereof as shown in FIG. 13 (according to the third embodiment).

When the scan signal is supplied to one of the scan lines S1 to Sn coupled with the connectors 310, the connectors 310 electrically connect the auxiliary line AL to one transistor that is turned-on when the scan signal is supplied. In practice, each of the connectors 310 includes a thirtieth transistor M31. A first electrode of the thirtieth transistor M31 is coupled with the auxiliary line AL, and a second electrode thereof is coupled with the voltage transfer unit 320.

When the thirtieth transistor M31 is turned-on, the voltage transfer unit 320 transfers a voltage value from the auxiliary line AL to the data driving circuits 200. In order to perform this function, the voltage transfer unit includes a buffer 321.

In the operation, when the scan signal is first supplied to a first scan line S1, the thirtieth transistor M31 coupled with the first scan line S1 is turned-on. When the thirtieth transistor M31 is turned-on, a voltage of the first reference power supply Vref dropped by the auxiliary line AL is provided to the buffer 321. Here, a voltage of a second reference power supply Vref2 is determined by subtracting a voltage corresponding to a voltage drop generated in the auxiliary line AL from the voltage of the first reference power Vref. The buffer 321 transfers the voltage of the second power supply Vref supplied from the thirtieth transistor M31 to the data driving circuits 200.

Also, during a first period of a supply period of the scan signal to the first scan line S1, a predetermined current from respective pixels 140 is supplied to the data driving circuit 200. This causes compensation voltages corresponding to respective pixels 140 to be applied to the data driving circuit 200. Upon receiving the compensation voltages and the voltage of the second reference power supply Vref2, the data driving circuit 200 boosts compensation voltages using the voltage of the second reference power supply Vref2. In practice, the data driving circuit 200 boosts the compensation voltages by a difference between the voltage of the first reference power supply Vref and the voltage of the second reference power supply Vref2. When the compensation voltages are boosted by a difference between the voltage of the first reference power supply Vref and the voltage of the second reference power supply Vref2, the compensation voltages dropped by the loads of the data lines D1 to Dm may be compensated. In other words, since the difference between the voltage of the reference power supply Vref and the second reference power supply Vref2 is set to be similar to a voltage drop of the data lines D1 to Dm, the voltage drop of the data lines D1 to Dm may be compensated for by boosting the compensation voltages, thereby allowing an image of desired data to be displayed in the pixels 140.

Next, every time the scan signal is sequentially provided to the second scan line S2 through the n-th scan line Sn, the voltage of the second reference power supply Vref2 is supplied to the data driving circuit 120, so that the compensation voltages may be stably compensated for corresponding to the voltage drop of the data lines D1 to Dm. In other words, since the connectors 310 coupled with respective scan lines S1 to Sn are coupled with the auxiliary line AL by different lengths, the voltage of the second power supply Vref2 generated corresponding to the voltage drop of the auxiliary line AL is generated to have different values every time the scan signal is supplied to the scan lines S1 to Sn. As a result, every time the scan signal is supplied to respective scan lines S1 to Sn, the compensation voltages generated in selected pixels are stably compensated.

Figure 14:
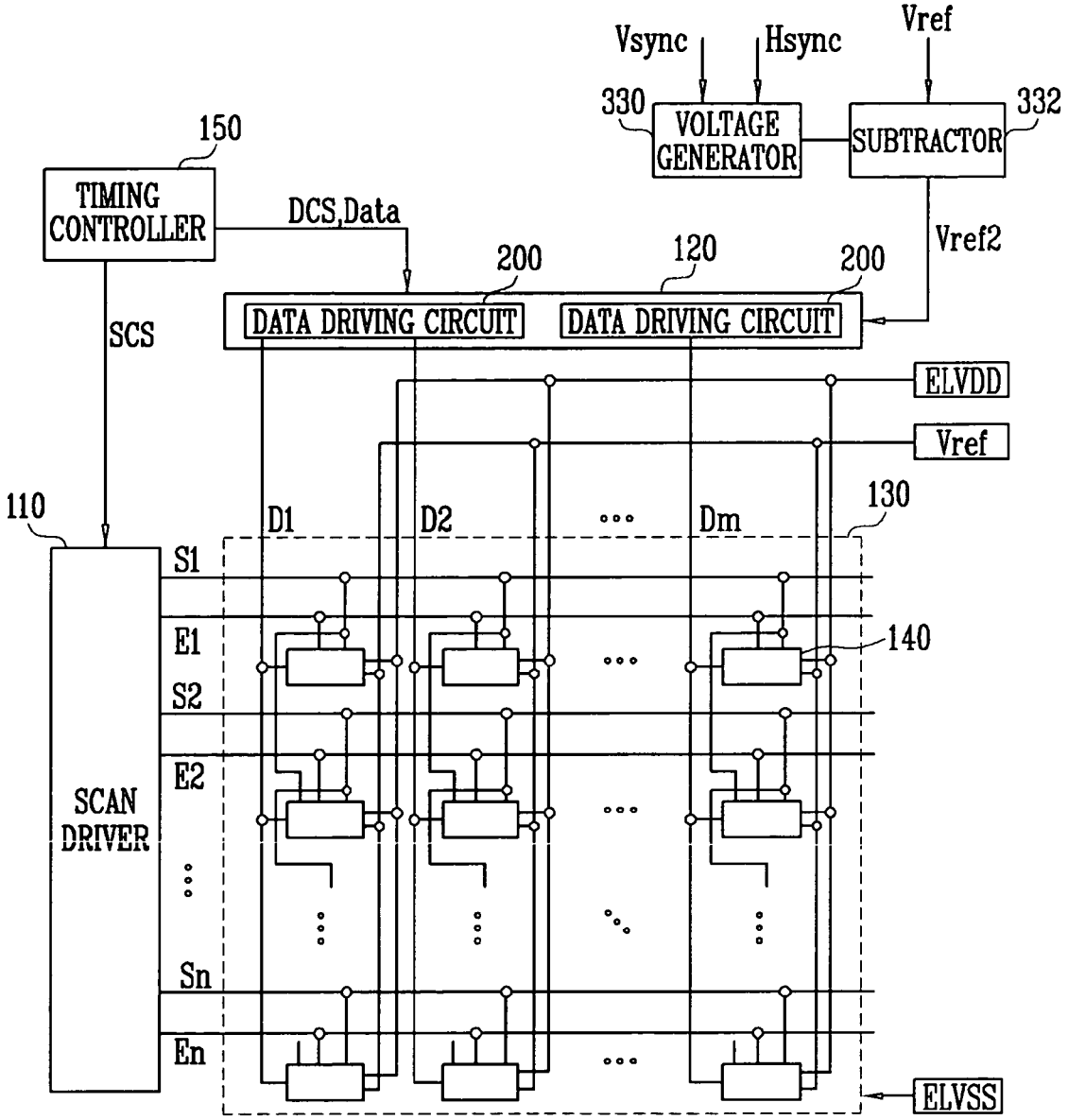
FIG. 14 is a view showing an organic light emitting display device according to a fourth embodiment of the present invention.

FIG. 14 is a view showing an organic light emitting display device according to a fourth embodiment of the present invention. In FIG. 14, elements that are substantially the same as those shown in FIG. 2 are allotted the same reference numerals, and the description of the same elements will be omitted.

With reference to FIG. 14, the organic light emitting display device according to the fourth embodiment of the present invention includes a voltage generator 330 and a subtracter 332.

The voltage generator 330 receives a vertical sync signal Vsync and a horizontal sync signal Hsync. Every time the horizontal sync signal is inputted to the voltage generator 332, the voltage generator 330 generates and provides a voltage increasing in a stepped form to the subtracter 332. Upon receiving the vertical sync signal Vsync, the voltage generator 330 is initialized.

Figure 15:
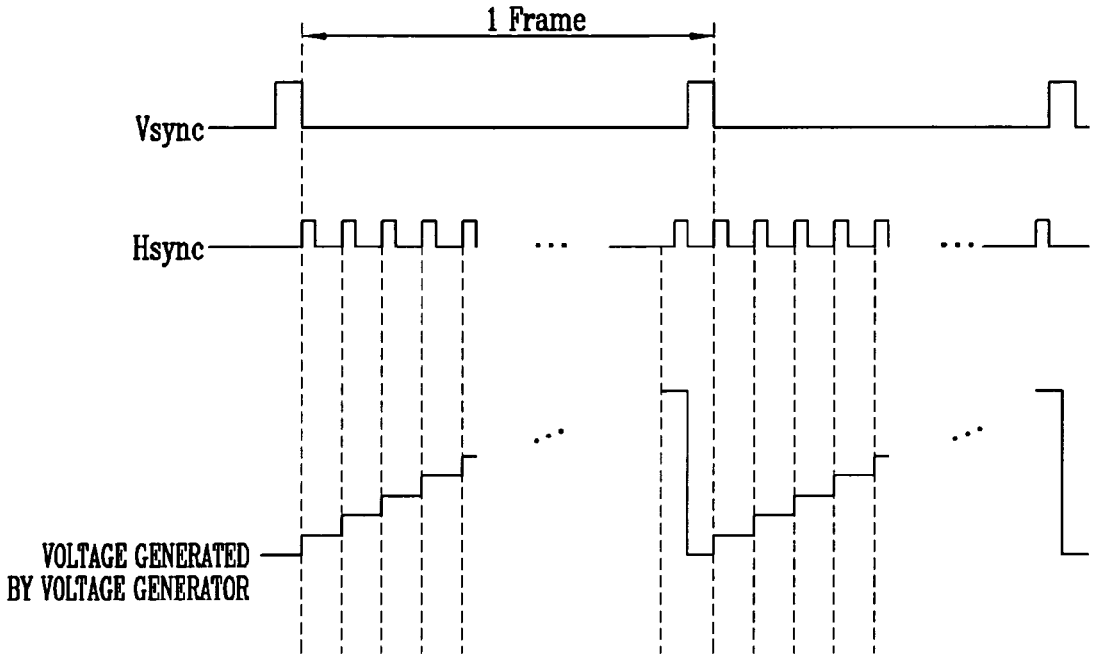
FIG. 15 is a view for illustrating an operation of a voltage generator shown in FIG. 14.

An operation of the voltage generator 330 having the construction mentioned above will be illustrated by reference to FIG. 15 in more detail. First, every time the vertical sync signal Vsync is inputted to the voltage generator 330, it is initialized as a predetermined voltage. Next, every time the horizontal sync signal is inputted to the voltage generator 332, the voltage generator 330 generates and provides a voltage increasing by a predetermined level to the subtracter 332. Here, the voltage generated by the voltage generator 330 is set to be identical with a voltage dropped according to a load of the data lines D1 to Dm.

In practice, the voltage increasing every time the horizontal sync signal Hsync is inputted to the voltage generator 330 is experimentally determined to be identical with or similar to a voltage dropped by the load of the data lines D1 to Dm, namely, a voltage drop of the compensation voltage. In other words, the voltage value increasing in the voltage generator 330 is set to be identical with or similar to a voltage drop of the compensation voltage generated when the scan signal is sequentially provided to the first scan line S1 to the n-th scan line Sn.

The subtracter 332 receives a voltage from a first reference power supply Vref and a voltage from the voltage generator 330. Upon receiving the voltage from the first reference power supply Vref and a voltage from the voltage generator 330, the subtracter 332 obtains a voltage of a second reference power supply Vref2 by subtracting the voltage from the voltage generator 330 from the voltage of the first reference power supply Vref, and provides the voltage of the second power supply Vref2 to the data driving circuits 200. Accordingly, the data driving circuit 200 boosts compensation voltages by a difference between the voltage of the first reference power supply Vref and the voltage of the second power supply Vref2. On the other hand, in the present invention, the voltage generated by the voltage generator 330 can be directly provided to the data driving circuit 200. In this case, the driving circuit 200 boosts the compensation voltages by the voltage supplied from the voltage generator 330.

As mentioned above, in accordance with an organic light emitting display device of the present invention using compensation voltages generated when an electric current is sunk from a pixel, since voltage values of a plurality of data voltages generated by a voltage generator are reset, and at least one of the reset data voltages is supplied to the pixel in which the electric current is sunk, a uniform image may be displayed regardless of a mobility of a transistor. Furthermore, in the present invention, when a voltage drop (or a drop-voltage) of the compensation voltage generated by a data line is generated, the compensation voltage is boosted by the amount of the voltage drop (or the drop-voltage), thereby allowing an image of desired brightness to be displayed in pixels.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An organic light emitting display device comprising:

a scan driver for driving a scan line and a light emitting control line, the scan line and the light emitting control line being formed parallel to each other;

a data driver for driving a data line formed at a direction crossing the scan line and the light emitting control line;

a pixel disposed to be coupled with the scan line, the light emitting control line, and the data line;

an auxiliary line formed parallel to the data line and crossing the scan line and another scan line, one side of the auxiliary line being coupled with a reference power supply and another side of the auxiliary line being coupled with a current source;

a connector disposed at a crossing area of the auxiliary line and the scan line, the connector comprising a transistor having a gate electrode coupled with the scan line; and a voltage transfer unit coupled with the connector for transferring a voltage supplied to the connector to the data driver, the voltage supplied from the voltage transfer unit to the data driver being set to a value obtained by subtracting a voltage value of a voltage drop of the auxiliary line from a voltage value of the reference power supply, wherein the data driver is coupled with the data line during a first period of one horizontal period, and the data driver is configured to receive a predetermined current from the pixel selected according to a scan signal and to reset a voltage value of a data signal using a compensation voltage generated when the predetermined current is received during the first period, and wherein the data driver is configured to provide the voltage value of the data signal to the pixel during a second period of the one horizontal period, the second period being a period other than the first period.

2. The organic light emitting display device as claimed in claim 1, wherein the scan driver provides a scan signal and a light emitting control signal to the scan line and the light emitting control line, respectively.

3. The organic light emitting display device as claimed in claim 2, wherein the current source receives substantially the same current as the predetermined current from the reference power supply via the auxiliary line.

4. The organic light emitting display device as claimed in claim 2, wherein a current value of the predetermined current is set to be substantially identical with a current value of an electric current flowing through an organic light emitting diode when the pixel emits light of a maximum brightness.

5. The organic light emitting display device as claimed in claim 2, wherein the transistor is turned-on when the scan signal is provided to the scan line to electrically connect the voltage transfer unit to the auxiliary line.

6. The organic light emitting display device as claimed in claim 2, wherein the voltage transfer unit includes at least one buffer.

7. The organic light emitting display device as claimed in claim 2, wherein the data driver boosts the compensation voltage by a difference between a voltage supplied from the voltage transfer unit and a voltage of the reference power supply.

8. The organic light emitting display device as claimed in claim 1, wherein the auxiliary line is formed at one side of the data line.

9. An organic light emitting display device comprising:

a scan driver for driving a scan line and a light emitting control line, the scan line and the light emitting control line being formed parallel to each other;

a data driver for driving a data line formed at a direction crossing the scan line and the light emitting control line;

a first pixel disposed to be coupled with the scan line, the light emitting control line, and the data line;

an auxiliary line formed parallel to the data line, one side of the auxiliary line being coupled with a reference power supply and another side of the auxiliary line being coupled with a current source;

a connector disposed at a crossing area of the auxiliary line and the scan line, the connector comprising a transistor having a gate electrode coupled with the scan line; and a voltage transfer unit coupled with the connector for transferring a voltage supplied to the connector to the data driver, wherein the scan line comprises a previous scan line and a present scan line, and wherein the pixel comprises:

a first power supply;

an organic light emitting diode for receiving an electric current from the first power supply;

a first transistor and a second transistor, the first transistor and the second transistor being coupled with the data line and being turned-on when a scan signal is supplied to the present scan line;

a third transistor coupled between a second electrode of the first transistor and the reference power supply, the third transistor being turned-on when the scan signal is supplied to the previous scan line;

a fourth transistor for controlling an amount of an electric current supplied to the organic light emitting diode; and a fifth transistor coupled between a gate electrode and a second electrode of the fourth transistor, the fifth transistor being turned-on to diode-connect the fourth transistor when the scan signal is supplied to the previous scan line.

10. The organic light emitting display device as claimed in claim 9, wherein the pixel further comprises:

a first capacitor coupled with a second electrode of the first transistor and the first power supply; and a second capacitor coupled with the second electrode of the first transistor and a gate electrode of the fourth transistor.

11. The organic light emitting display device as claimed in claim 9, wherein the pixel further comprises:

a first capacitor coupled with a gate electrode of the fourth transistor and the first power supply; and a second capacitor coupled with a second electrode of the first transistor and a gate electrode of the fourth transistor.

12. The organic light emitting display device as claimed in claim 9, further comprising a sixth transistor coupled between a second electrode of the fourth transistor and the organic light emitting diode, the sixth transistor being turned-off when the light emitting control signal is supplied and being turned-on during substantially all other remaining periods.

13. An organic light emitting display device, comprising:

a display region including a pixel coupled with a scan line, a light emitting control line, and a data line;

a scan driver for providing a scan signal and a light emitting control signal to the scan line and the light emitting control line, respectively;

a data driver coupled with the data line during a first period of one horizontal period for receiving a predetermined current from the pixel selected according to the scan signal, the data driver being for resetting a voltage value of a data signal using a compensation voltage generated when the predetermined current is received and for providing the voltage value of the data signal to the pixel during a second period of the one horizontal period, the second period being a period other than the first period; and a voltage generator for generating and providing a voltage in each of a plurality of horizontal periods when the scan signal is supplied to the data driver, the horizontal periods comprising a first horizontal period and a second horizontal period following the first horizontal period, wherein the voltage provided by the voltage generator in the second horizontal period is increased to a sum of the voltage provided by the voltage generator in the first horizontal period and a predetermined voltage.

14. The organic light emitting display device as claimed in claim 13, wherein the voltage generator provides the voltage increased by the predetermined voltage every time an external horizontal sync signal is supplied to the data driver, and is initialized when an external vertical sync signal is supplied.

15. The organic light emitting display device as claimed in claim 13, wherein a voltage generated by the voltage generator is set to be substantially identical with a voltage drop of the compensation voltage generated by the data line.

16. The organic light emitting display device as claimed in claim 15, wherein the data driver boosts a voltage value of the compensation voltage by a voltage value generated by the voltage generator.

17. The organic light emitting display device as claimed in claim 15, further comprising a subtracter coupled between the voltage generator and the data driver, the subtracter being for subtracting a voltage value supplied from the voltage generator from a voltage value of a first reference power supply supplied from an exterior to obtain a voltage value of a second reference power supply, and for providing the voltage value of the second power supply to the data driver.

18. The organic light emitting display device as claimed in claim 17, wherein the data driver boosts a voltage value of the compensation voltage by a difference between the voltage value of the first reference power supply and the voltage value of the second reference power supply.

19. An organic light emitting display device, comprising:

a display region including a pixel coupled with a scan line, a light emitting control line, and a data line;

a scan driver for providing a scan signal and a light emitting control signal to the scan line and the light emitting control line, respectively;

a data driver coupled with the data line during a first period of one horizontal period for receiving a predetermined current from the pixel selected according to the scan signal, the data driver being for resetting a voltage value of a data signal using a compensation voltage generated when the predetermined current is received and for providing a reset voltage value of the data signal to the pixel during a second period of the one horizontal period, the second period being a period other than the first period;

a voltage generator for generating and providing a voltage increased by a predetermined level in every horizontal period when the scan signal is supplied to the data driver, and a subtracter coupled between the voltage generator and the data driver, the subtracter being for subtracting a voltage value supplied from the voltage generator from a voltage value of a first reference power supply supplied from an exterior to obtain a voltage value of a second reference power supply, and for providing the voltage value of the second power supply to the data driver, wherein a voltage generated by the voltage generator is set to be substantially identical with a voltage drop of the compensation voltage generated by the data line, wherein the data driver boosts a voltage value of the compensation voltage by a difference between the voltage value of the first reference power supply and the voltage value of the second reference power supply, and wherein the scan line comprises a previous scan line and a present scan line, and wherein the pixel includes:

a first power supply;

an organic light emitting diode for receiving an electric current from the first power supply;

a first transistor and a second transistor, the first transistor and the second transistor being coupled with the data line and being turned-on when the scan signal is supplied to the present scan line;

a third transistor coupled between a second electrode of the first transistor and the reference power supply, the third transistor being turned-on when the scan signal is supplied to the previous scan line;

a fourth transistor for controlling an amount of an electric current supplied to the organic light emitting diode; and a fifth transistor coupled between a gate electrode and a second electrode of the fourth transistor, the fifth transistor being turned-on to diode-connect the fourth transistor when the scan signal is supplied to the previous scan line.

20. The organic light emitting display device as claimed in claim 19, wherein the pixel further comprises:

a first capacitor coupled with a second electrode of the first transistor and the first power supply; and a second capacitor coupled with the second electrode of the first transistor and a gate electrode of the fourth transistor.

21. The organic light emitting display device as claimed in claim 19, wherein the pixel further comprises:

a first capacitor coupled with a gate electrode of the fourth transistor and the first power supply; and a second capacitor coupled with a second electrode of the first transistor and a gate electrode of the fourth transistor.

22. The organic light emitting display device as claimed in claim 19, further comprising a sixth transistor coupled between a second electrode of the fourth transistor and the organic light emitting diode, the sixth transistor being turned-off when the light emitting control signal is supplied and being turned-on during substantially all other remaining periods.

* * * * *